US010981207B2

(12) United States Patent
Nomura et al.

(10) Patent No.: US 10,981,207 B2
(45) Date of Patent: Apr. 20, 2021

(54) HOT PRESS DEVICE

(71) Applicant: NIPPON STEEL & SUMITOMO METAL CORPORATION, Tokyo (JP)

(72) Inventors: Naruhiko Nomura, Tokyo (JP); Yoshiaki Nakazawa, Tokyo (JP); Toshiya Suzuki, Tokyo (JP); Yasuhiro Ito, Tokyo (JP); Ryousuke Morimoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/330,339

(22) PCT Filed: Aug. 31, 2017

(86) PCT No.: PCT/JP2017/031446
§ 371 (c)(1),
(2) Date: Mar. 4, 2019

(87) PCT Pub. No.: WO2018/047713
PCT Pub. Date: Mar. 15, 2018

(65) Prior Publication Data

US 2019/0201961 A1 Jul. 4, 2019

(30) Foreign Application Priority Data

Sep. 6, 2016 (JP) ..... JP2016-173990

(51) Int. Cl.
*B21D 24/00* (2006.01)
*B21D 22/20* (2006.01)
(Continued)

(52) U.S. Cl.
CPC ..... *B21D 22/20* (2013.01); *B21D 24/00* (2013.01); *B21D 24/005* (2013.01); *B21D 37/16* (2013.01); *B21D 43/05* (2013.01)

(58) Field of Classification Search
CPC .... B21D 22/022; B21D 24/005; B21D 24/16; B21D 37/16; B21D 43/05; B21D 22/20
See application file for complete search history.

(56) References Cited

U.S. PATENT DOCUMENTS

2010/0288009 A1 11/2010 Ishiguro et al.
2011/0283851 A1* 11/2011 Overrath ..... B21D 22/00 83/15
(Continued)

FOREIGN PATENT DOCUMENTS

CN 105492135 A 4/2016
DE 10 2006 015 666 A1 10/2007
(Continued)

OTHER PUBLICATIONS

International Preliminary Report on Patentability for PCT/JP2017/031446 (PCT/IPEA/409) dated Oct. 15, 2018.
(Continued)

*Primary Examiner* — Debra M Sullivan
(74) *Attorney, Agent, or Firm* — Birch, Stewart, Kolasch & Birch, LLP

(57) ABSTRACT

A hot press device according to the present disclosure includes a first press, a second press, a conveyance device linking the first press and the second press together, and a heating furnace provided within a conveyance range of the conveyance device.

9 Claims, 10 Drawing Sheets

(51) Int. Cl.
*B21D 43/05* (2006.01)
*B21D 37/16* (2006.01)

(56) References Cited

U.S. PATENT DOCUMENTS

| | | | | |
|---|---|---|---|---|
| 2014/0069162 | A1 | 3/2014 | Fukuchi et al. | |
| 2015/0209840 | A1* | 7/2015 | Koyer | C21D 9/0056 72/40 |
| 2016/0167101 | A1* | 6/2016 | Fukuchi | B21D 22/022 72/342.4 |
| 2019/0091748 | A1* | 3/2019 | Nakazawa | B21J 9/08 |

FOREIGN PATENT DOCUMENTS

| | | | |
|---|---|---|---|
| DE | 10 2010 049 205 | A1 | 4/2012 |
| DE | 10 2012 112 334 | A1 | 6/2014 |
| DE | 102012112334 | A1 * | 6/2014 |
| DE | 10 2014 109 883 | A1 | 1/2016 |
| JP | 2004-160489 | A | 6/2004 |
| JP | 2006-289425 | A | 10/2006 |
| JP | 2007-136534 | A | 6/2007 |
| JP | 2008-296237 | A | 12/2008 |
| JP | 2009-142852 | A | 7/2009 |
| JP | 2009-285728 | A | 12/2009 |
| JP | 2013-212520 | A | 10/2013 |
| JP | 2013-240817 | A | 12/2013 |
| WO | WO 2012/161192 | A1 | 11/2012 |

OTHER PUBLICATIONS

International Search Report for PCT/JP2017/031446 dated Nov. 21, 2017.

Written Opinion of the International Preliminary Examining Authority for PCT/JP2017/031446 (PCT/IPEA/408) dated Jun. 5, 2018.

Written Opinion of the International Searching Authority for PCT/JP2017/031446 (PCT/ISA/237) dated Nov. 21, 2017.

Korean Office Action dated Apr. 10, 2019, for corresponding Korean Patent Application No. 10-2019-7008676, with partial English translation.

Chinese Office Action dated Aug. 7, 2019, for corresponding Chinese Application No. 201780054009.2, with partial English translation.

* cited by examiner

HOT PRESS DEVICE

TECHNICAL FIELD

The present disclosure relates to a hot press device that heats and presses a pressing target.

BACKGROUND ART

For example, Japanese Patent Application Laid-Open (JP-A) Nos. 2009-142852 (Patent Document 1) and 2009-285728 (Patent Document 2) disclose hot press devices. These hot press devices are configured by a single heating furnace, a single press, and a conveyance device to convey a pressing target from the heating furnace to the press. Hot pressing is performed by conveying sheet steel that has been heated in the heating furnace to the press for pressing by the press.

SUMMARY OF INVENTION

Technical Problem

In addition to securing ductility and toughness, there is demand for even greater strength in sheet steel that is hot pressed in a hot press device.

An object of the present disclosure is to provide a hot press device capable of achieving even greater strength in addition to ductility and toughness in sheet steel.

Solution to Problem

A hot press device addressing the above issue includes a first press, a second press, a conveyance device linking the first press and the second press together, and a heating furnace provided within a conveyance range of the conveyance device.

Advantageous Effects of Invention

The hot press device of the present disclosure is capable of achieving even greater strength in addition to ductility and toughness in sheet steel.

DESCRIPTION OF EMBODIMENTS

Figure 1:
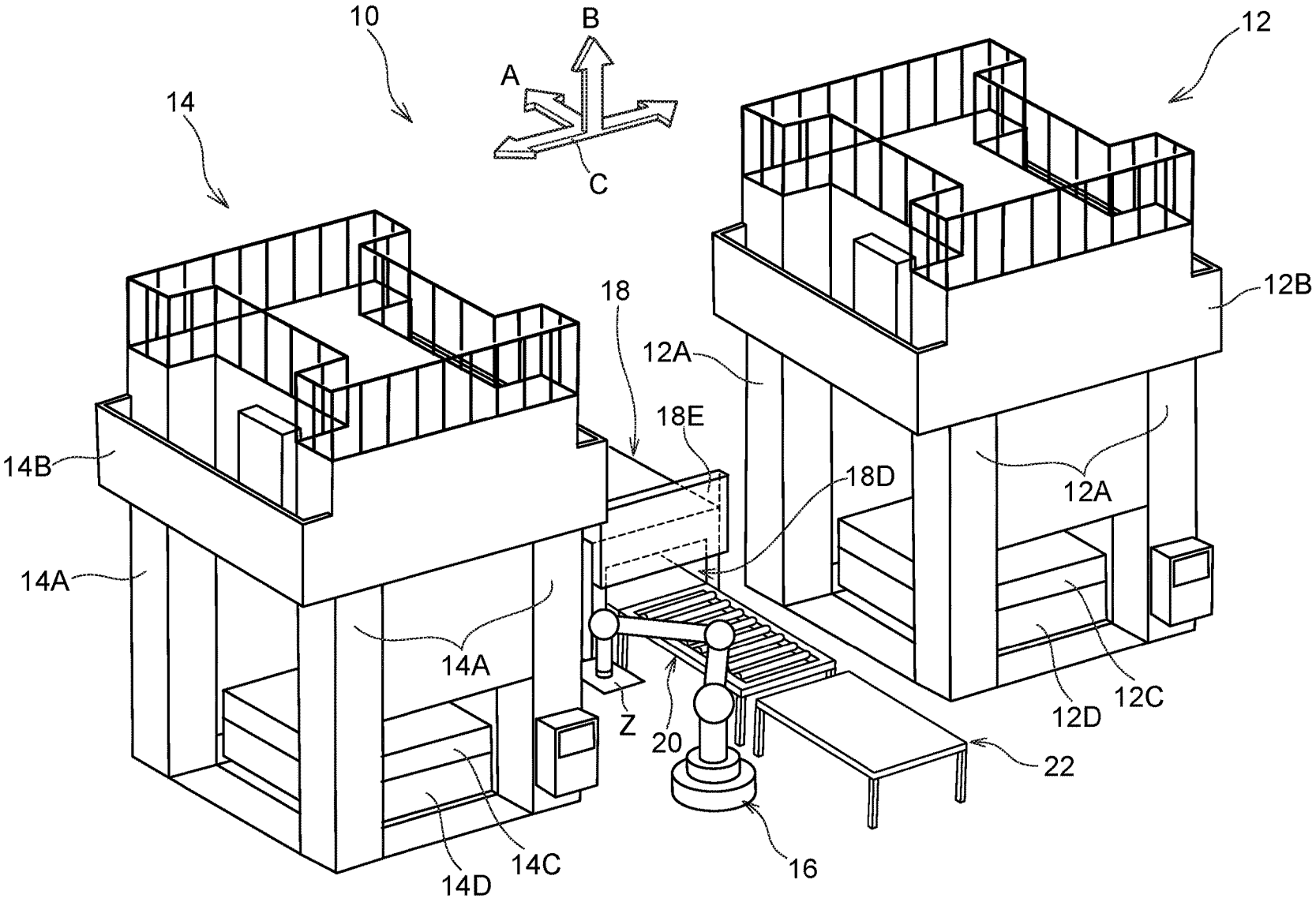
FIG. 1 is a schematic perspective view illustrating a hot press device according to a first exemplary embodiment.

Hot pressed members with high strength characteristics are employed in vehicle components used as collision countermeasures. Improvements in the ductility and toughness of such hot pressed components are demanded in order to achieve greater strength.

In addressing these demands, the inventors have discovered that high strength characteristics can be obtained by performing plural repetitions of heating and cooling cycles.

Conventional hot press devices are configured by a single heating furnace, a single press with a workpiece cooling function, and a conveyance device to convey the pressing target from the heating furnace to the press.

Hot press forming of high strength sheet steel is simpler than cold forming. Employing hot press forming enables a high strength formed product to be formed in a single pressing process. Plural repetitions of heating and cooling cycles are therefore not envisaged in conventional hot press devices.

When plural repetitions of heating and cooling cycles are performed, temperature management is necessary during processing in order to maintain the desired characteristics. However, since there has hitherto been no research into forming methods involving plural repetitions of heating and cooling cycles, there has similarly been no research into devices that would achieve such a method. This has led the inventors to the following exemplary embodiments.

First Exemplary Embodiment

Explanation follows regarding a first exemplary embodiment of the present disclosure, with reference to the drawings. In the drawings, a back side is indicated by the arrow A, an upper side is indicated by the arrow B, and a lateral direction is indicated by the arrow C.

Figure 2:
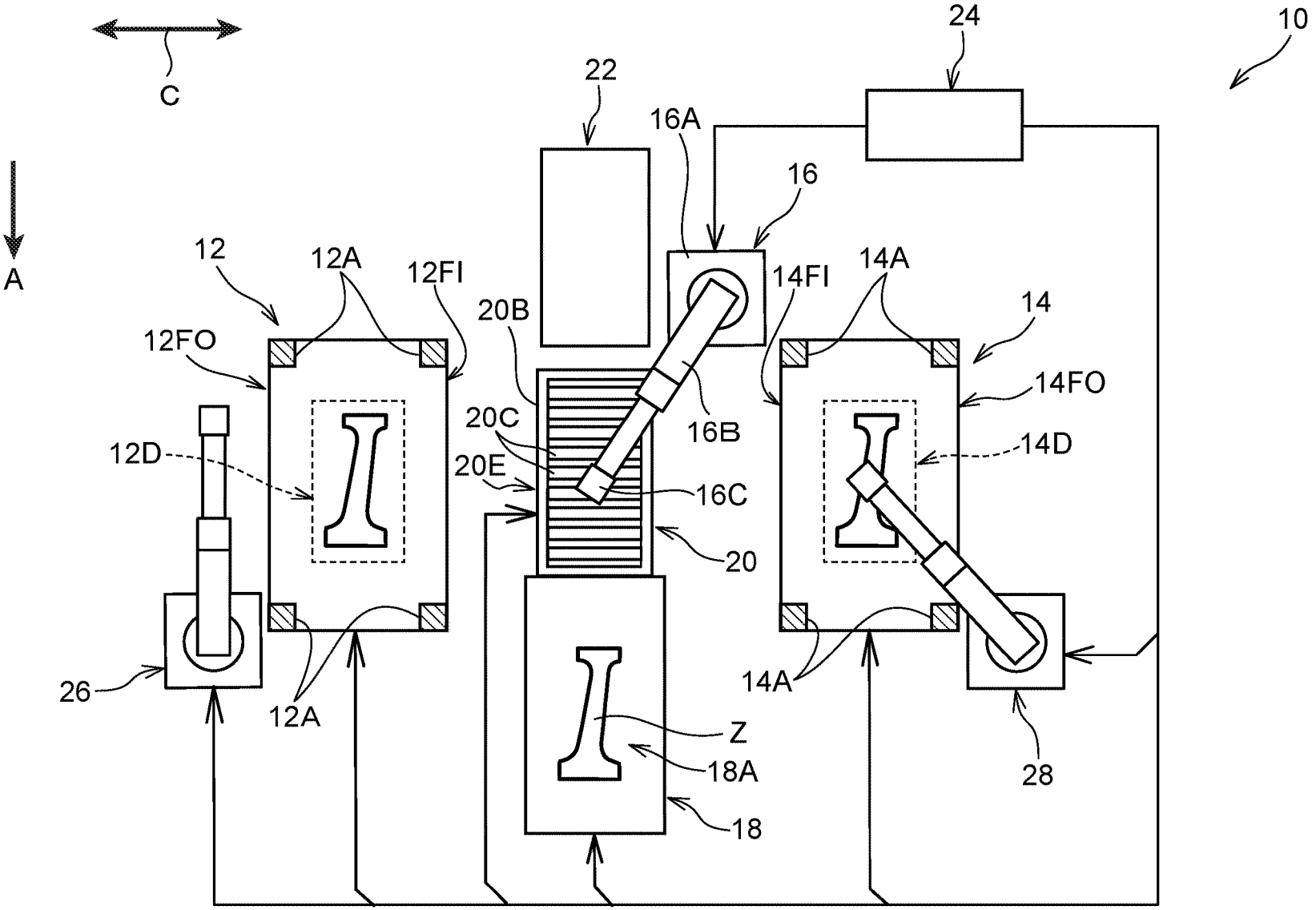
FIG. 2 is a schematic plan view illustrating a hot press device according to the first exemplary embodiment.

FIG. 1 and FIG. 2 are schematic drawings illustrating a hot press device 10 according to the present exemplary embodiment. The hot press device 10 includes a press 12 and a press 14. A first manipulator 16, this being an example of a conveyance device linking the two presses 12, 14 together, is provided between the press 12 and the press 14 in the vicinity of a corner of the press 14.

The first manipulator 16 conveys a material Z configured by sheet steel and moves the material Z in and out of the presses 12, 14. The presses 12, 14 are therefore disposed within a conveyance range of the first manipulator 16. The two presses 12, 14 are linked together by the first manipulator 16 in this manner.

The first manipulator 16 may be installed above a heating furnace 18. This applies not only to the first exemplary embodiment, but also to other exemplary embodiments, in which a manipulator that moves the material Z in and out of a heating furnace may be installed above the heating furnace.

The heating furnace 18 is provided within the conveyance range of the first manipulator 16. The heating furnace 18 is disposed between the first press 12 and the second press 14 at the back side A of the two presses 12, 14. The material Z is moved between the heating furnace 18 and the press 12, and between the heating furnace 18 and the press 14, by moving the material Z between the heating furnace 18 and the presses 12, 14 with the first manipulator 16.

Figure 3:
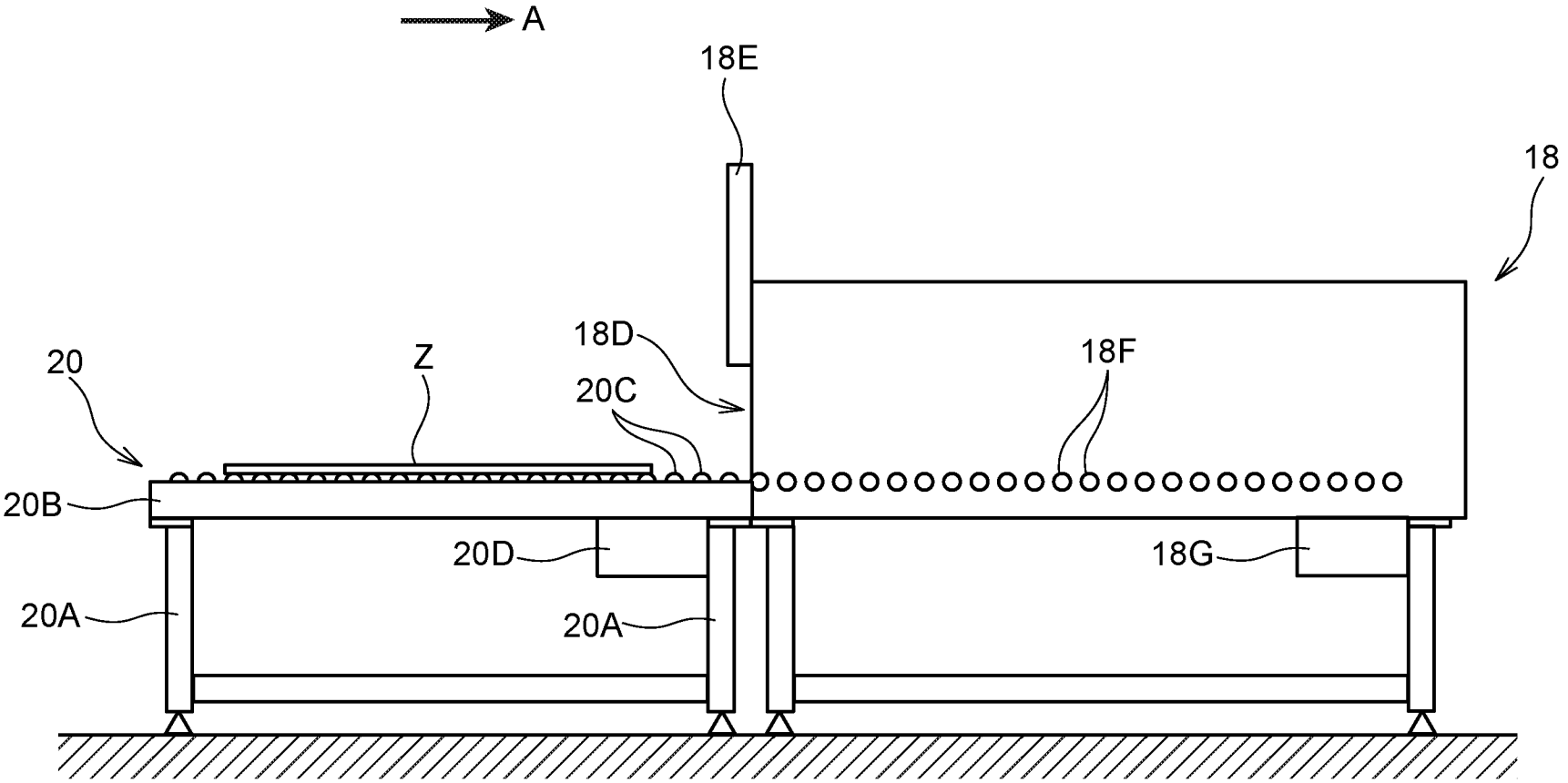
FIG. 3 is an explanatory diagram illustrating a conveyance table of the first exemplary embodiment as viewed from the side.

The heating furnace 18 is a device used to heat the material Z configuring a heating target. Examples of the heating furnace 18 include a high frequency furnace, a resistance furnace, a gas furnace, or an infrared furnace. As illustrated in FIG. 1 and FIG. 3, the heating furnace 18 includes a door 18E that is capable of opening and closing an entry/exit port 18D. The door 18E is capable of changing the opening height when the entry/exit port 18D is open according to the size of the target material Z.

As illustrated in FIG. 3, the heating furnace 18 includes a drive section 18G that drives rotation of rollers 18F provided inside the heating furnace 18. An electrical heater may be employed as a heating means instead of the heating furnace.

As illustrated in FIG. 1 and FIG. 2, the press 12 is configured by a hydraulic press that press-forms the material Z by applying a large load. The press 12 includes four columns 12A, and a roof 12B supported by the columns 12A. As illustrated in FIG. 2, the press 12 is formed with a rectangular profile in plan view, and the material Z enters and leaves at a side corresponding to a long edge. The press 12 is not limited to a hydraulic press, and may be configured by another type of press, such as a servo press. The same applies to the presses of the other exemplary embodiments.

As illustrated in FIG. 1, an upper die 12C and a lower die 12D configuring a pair are provided at the inside of the respective columns 12A. The upper die 12C is driven in the up-down direction with respect to the lower die 12D by a raising/lowering mechanism (not illustrated in the drawings). One out of the upper die 12C or the lower die 12D is a protruding die (punch), and the other out of the upper die 12C or the lower die 12D is a recessed die (die) corresponding to the protruding die.

The material Z is placed on the lower die 12D and press formed with the upper die 12C. The material Z is cooled in a state clamped between the upper die 12C and the lower die 12D. The upper die 12C and the lower die 12D include coolant flow paths. The heat removed from the material Z during pressing is dissipated by the coolant.

The press 14 is configured by a high-speed forming servo device, and the press speed and the like can be adjusted by controlling a servo motor. The press 14 includes four columns 14A, and a roof 14B supported by the columns 14A. As illustrated in FIG. 2, the press 14 is formed with a rectangular profile in plan view, and the material Z enters and leaves at a side corresponding to a long edge.

An upper die 14C and a lower die 14D configuring a pair are provided at the inside of the respective columns 14A. The upper die 14C is driven in the up-down direction with respect to the lower die 14D by a raising/lowering mechanism (not illustrated in the drawings). One out of the upper die 14C or the lower die 14D is a protruding die, and the other out of the upper die 12C or the lower die 12D is a recessed die corresponding to the one protruding die.

The upper die 14C and the lower die 14D have similar functions to the upper die 12C and the lower die 12D, and differ only in that the profiles of the dies are different.

As illustrated in FIG. 2, a conveyance table 20 is provided between the two presses 12, 14. One entry/exit port 12FI, serving as an example of a material Z insertion port of the press 12, opens toward the conveyance table 20 side of the press 12. One entry/exit port 14FI, serving as an example of a material Z insertion port of the press 14, opens toward the conveyance table 20 side of the press 14.

As illustrated in FIG. 3, the conveyance table 20 includes four legs 20A. A tabletop 20B supported by the legs 20A is formed in a rectangular frame shape (see FIG. 1). Plural circular column shaped rollers 20C extending in a width direction of the tabletop 20B are disposed in a length direction of the tabletop 20B within the frame. Each of the rollers 20C is coupled to a drive section 20D and is capable of being rotation driven.

The respective rollers 20C are disposed at the same height as the rollers 18F inside the heating furnace 18 provided at one end side of the conveyance table 20. The material Z is thus moved between the conveyance table 20 and the heating furnace 18 by moving over the respective rollers 20C, 20F of the conveyance table 20 and the heating furnace 18.

As illustrated in FIG. 2, a material table 22 is provided at the other end side of the conveyance table 20. The first manipulator 16 is disposed between the material table 22 and the press 14.

The first manipulator 16 includes a rotating base 16A, an articulated arm 16B rotatably supported on the rotating base 16A, and an exchangeable holding tool 16C attached to a leading end of the articulated arm 16B. The material table 22, the conveyance table 20, the press 12, the press 14, and the heating furnace 18 are provided within a movement range of the material Z by the holding tool 16C. The holding tool 16C includes a suction holding mechanism that uses suction to hold the material Z, and a hooking holding mechanism that holds the material Z by hooking the material Z. Note that a gripper holding mechanism that holds the material Z by gripping the material Z may be provided instead of the hooking holding mechanism.

A controller 24 configured by an industrial computer or the like is connected to the first manipulator 16. The controller 24 is also connected to the two presses 12, 14, the heating furnace 18, and the conveyance table 20. The first manipulator 16, the two presses 12, 14, the heating furnace 18, and the conveyance table 20 are thus operated according to commands expressed by control signals output from the controller 24.

A second manipulator 26, configured similarly to the first manipulator 16, is provided in the vicinity of a corner of the press 12. The controller 24 is also connected to the second manipulator 26, and the second manipulator 26 is operated according to commands expressed by control signals from the controller 24.

The second manipulator 26 removes the material Z that has been pressed in the press 12 through another entry/exit port 12FO and places the material Z on a linear conveyance mechanism (not illustrated in the drawings), and the material Z is conveyed to a subsequent process at high speed by the linear conveyance mechanism.

A third manipulator 28, configured similarly to the first manipulator 16, is provided in the vicinity of a corner of the press 14. The controller 24 is also connected to the third manipulator 28, and the third manipulator 28 is operated according to commands expressed by control signals from the controller 24.

The third manipulator 28 removes the material Z that has been pressed in the press 14 through another entry/exit port 14FO and places the material Z on a linear conveyance mechanism (not illustrated in the drawings), enabling the material Z to be conveyed to a subsequent process at high speed by the linear conveyance mechanism.

Note that in the present exemplary embodiment, the first manipulator 16 is described as an example of a conveyance device; however, there is no limitation thereto. For example, the conveyance device may be configured by a conveyor. In cases in which a conveyance device is configured by plural manipulators and conveyors, if the conveyance paths thereof overlap or are connected, the plural manipulators, linear conveyance mechanisms, and conveyors are considered to be a single conveyance device. In cases in which the conveyance paths thereof do not overlap or are not connected, the plural manipulators, linear conveyance mechanisms, and conveyors are considered to be separate conveyance devices. Similar also applies in subsequent exemplary embodiments.

In cases in which a conveyor is employed, a conveyance path configuring a conveyance range is a conveyance path configured by the conveyor. In cases in which a robot or a manipulator is employed, a conveyance path is configured by a movement range of a robot hand or the holding tool 16C of the manipulator. In cases in which a conveyor and a manipulator are employed, a conveyance path is configured by a movement range of the conveyor and the holding tool 16C of the manipulator. Similar also applies in subsequent exemplary embodiments.

Explanation follows regarding a process for forming a formed product in which heating is performed twice in the present exemplary embodiment configured as described above. The controller 24 operates according to a program stored in an internal storage medium so as to output respective control signals to the manipulators 26, 28, the presses 12, 14, the heating furnace 18, and the conveyance table 20. The manipulators 26, 28, the presses 12, 14, the heating furnace 18, and the conveyance table 20 are operated according to the control signals from the controller 24.

Namely, when forming a formed product from a blank, the material Z (blank) is placed on the material table 22 in advance. In this state, the controller 24 commences operation according to the stored program, and outputs a control signal to the first manipulator 16 such that the first manipulator 16 holds and conveys the material Z (blank) placed on the material table 22 to the conveyance table 20 using the holding tool 16C of the suction holding mechanism.

The controller 24 then outputs control signals to the heating furnace 18 and the conveyance table 20. When this is performed, the heating furnace 18 actuates the door 18E so as to open the entry/exit port 18D to an opening height adjusted according to the size of the material Z (blank) to be heated.

The drive section 20D of the conveyance table 20 rotates the rollers 20C, and the drive section 18G of the heating furnace 18 rotates the rollers 18F. The drive section 20D of the conveyance table 20 and the drive section 18G of the heating furnace 18 accordingly load the material Z (blank) inside the heating furnace 18 by driving the respective rollers.

Note, that in the present exemplary embodiment, the material Z (blank) on the conveyance table 20 is loaded into the heating furnace 18 by the rollers 20C of the conveyance table 20 and the rollers 18F of the heating furnace 18. Accordingly, the conveyance table 20 configures a loading device for the heating furnace 18, and the conveyance table 20 may be considered to be part of the heating furnace 18.

The heating furnace 18 follows the control signals from the controller 24 to heat the material Z (blank) for a set duration (for example 4 minutes) at a set temperature (for example approximately 1000° C.). The rollers 20C of the conveyance table 20 and the rollers 18F of the heating furnace 18 are then driven to discharge the heated material Z (blank) onto the conveyance table 20.

In this manner, the rollers 20C of the conveyance table 20 and the rollers 18F of the heating furnace 18 configure a conveyance mechanism for moving the material Z back and forth between a first placement position 18A positioned inside the heating furnace 18, and a second placement position 20E positioned within the conveyance range but outside the heating furnace 18.

The first manipulator 16 is capable of conveying the material Z directly between the at least one out of the presses 12 or 14 and the second placement position 20E. The first manipulator 16 configuring the conveyance device accordingly has a conveyance function to convey the material Z from at least one out of the presses 12 or 14 to the heating furnace 18. Note that direct conveyance refers to conveyance in which the material Z is not passed or exchanged and is not relayed through a separate location en-route during conveyance.

It is desirable that the first manipulator 16 be capable of conveying the material Z directly between each of the presses 12, 14 and the second placement position 20E. In the present exemplary embodiment, the first manipulator 16 conveys the material Z directly between the presses 12, 14 configuring plural presses and the second placement position 20E. This enables a combination of a heating process and a pressing process to be performed twice while managing the temperature of the workpiece.

Note that the time taken for the material Z (blank) to enter or leave the heating furnace 18 is set to within 2 seconds for a material Z with a length of 1.5 m in the heating furnace insertion direction (referred to hereafter as the insertion direction) (i.e. at a conveyance speed of at least 750 mm/s).

The material Z (heated blank) discharged onto the conveyance table 20 is held and lifted up by the holding tool 16C of the first manipulator 16 that has been exchanged for the hooking holding mechanism under the control of the controller 24. The first manipulator 16 controlled by the controller 24 conveys the lifted material Z (heated blank) to the press 12 and sets the material Z (heated blank) on the lower die 12D of the press 12.

The press 12 lowers the upper die 12C according to a command from the controller 24 to press form the material Z (heated blank) clamped between the upper die 12C and the lower die 12D. When this is performed, the heat of the material Z (heated blank) is rapidly removed by the upper die 12C and the lower die 12D. The heat removal amount is particularly large when the dies reach bottom dead center and the material Z is held clamped between the upper die 12C and the lower die 12D. This corresponds to a first hot pressing.

When this is performed, the time taken from discharging the material Z (heated blank) from the heating furnace 18 to holding the material Z (heated blank) clamped between the upper die 12C and the lower die 12D is managed. This time is, for example, approximately 8 seconds.

Note that in the present exemplary embodiment, the material Z (heated blank) discharged onto the conveyance table 20 is set in the press 12 by the first manipulator 16; however, there is no limitation thereto. A linear conveyance mechanism (not illustrated in the drawings) may be provided between the conveyance table 20 and the press 12 such that the material Z (heated blank) discharged onto the conveyance table 20 from the heating furnace 18 is lifted up by the first manipulator 16 and then set in the press 12 at high speed using the linear conveyance mechanism, thereby achieving an increase in speed and a reduction in the time taken.

Next, the material Z (heated blank) is pressed so as to be held and cooled continuously for a predetermined pressing duration (for example 10 seconds) by the press 12, after which the upper die 12C is raised and the press 12 is opened. A lifting mechanism (not illustrated in the drawings) of the press 12 lifts up and releases the pressed material Z (intermediate product) from the lower die 12D. When this is performed, in response to a command from the controller 24, the first manipulator 16 conveys the pressed material Z (intermediate product) to the conveyance table 20 using the holding tool 16C of the hooking holding mechanism. The material Z (intermediate product) conveyed to the conveyance table 20 is thereby once again loaded into the heating furnace 18 by driving the rollers with a command from the controller 24.

The heating furnace 18 reheats the loaded material Z (intermediate product) according to a command from the controller 24, and after the material Z (intermediate product) reaches a reheat temperature (for example 900° C.), the material Z (intermediate product) is held at the reheat temperature for a predetermined duration (for example 2 minutes). The heating furnace 18 then discharges the material Z (heated intermediate product) to the conveyance table 20 by driving the rollers described above.

When this is performed, the time taken for the material Z (heated intermediate product) to enter or leave the heating furnace 18 is set to within approximately 2 seconds for a material with a length of 1.5 m in the insertion direction (i.e. at a conveyance speed of at least 750 mm/s).

The material Z (heated intermediate product) discharged onto the conveyance table 20 is held by the holding tool 16C of the hooking holding mechanism of the first manipulator 16 under the control of the controller 24. When this is performed, the controller 24 computes a position to hook the material Z (heated intermediate product) with the hooking holding mechanism in consideration of the amount of thermal expansion of the material Z (heated intermediate product), and outputs a control signal to the first manipulator 16. The first manipulator 16 conveys the held and lifted material Z (heated intermediate product) to the press 14 using the holding tool 16C of the hooking holding mechanism, and sets the material Z (heated intermediate product) on the lower die 14D of the press 14.

The press 14 lowers the upper die 14C according to a command from the controller 24, and press forms the material Z (heated intermediate product) clamped between the upper die 14C and the lower die 14D. When this is performed, the heat of the material Z (heated intermediate product) is rapidly removed by the upper die 14C and the lower die 14D. The heat removal amount is particularly large when the dies reach bottom dead center and the material Z is held clamped between the upper die 14C and the lower die 14D. This corresponds to a second hot pressing.

When this is performed, the time taken from discharging the material Z (heated intermediate product) from the heating furnace 18 to holding the material Z (heated intermediate product) clamped between the upper die 14C and the lower die 14D is managed. The time is, for example, approximately 8 seconds.

Note that in the present exemplary embodiment, the material Z (heated intermediate product) discharged onto the conveyance table 20 is set in the press 14 by the first manipulator 16; however, there is no limitation thereto. A linear conveyance mechanism (not illustrated in the drawings) may be provided between the conveyance table 20 and the press 14 such that the material Z (heated intermediate product) discharged onto the conveyance table 20 from the heating furnace 18 is lifted up by the first manipulator 16 and then set in the press 14 at high speed using the linear conveyance mechanism, thereby achieving an increase in speed and a reduction in the time taken.

The dies of the press 14 have profiles adapted to the size of the finished product in consideration of the thermal expansion of the material Z (heated intermediate product). The material Z (heated intermediate product) is pressed so as to be held and cooled continuously for a predetermined pressing duration (for example 15 seconds) by the press 14, after which the upper die 14C is raised and the press 14 is opened. A lifting mechanism (not illustrated in the drawings) of the press 14 lifts up and releases the pressed material Z (formed product) from the lower die 14D.

Then, in response to a command from the controller 24, the third manipulator 28 lifts up the material Z (formed product) that has been released from the lower die 14D and conveys the material Z (formed product) out of the press 14 to be passed to a subsequent process.

Note that in the present exemplary embodiment, the cycle time is approximately 7 minutes per component when the two heating durations and conveyance durations are added together.

In this manner, in the hot press device 10 of the present exemplary embodiment, thermal history control can be performed by hot pressing the material Z to be pressed plural times (twice in the present exemplary embodiment). This thereby enables an ultra-high strength hot pressed formed product in which the toughness has been raised to be obtained by quenching during the plural hot pressings.

Namely, during the first hot pressing, after the material Z undergoing pressing has been converted into austenite and carbides have been fully converted into a solid solution, the material Z is caused to undergo a phase transformation to a hard phase (by martensite transformation or bainite transformation). This enables the material Z (intermediate product) to be press formed in a state in which in which the austenite grain size is smaller than in cases in which the material Z undergoing pressing becomes ferrite-pearlite.

When heating the pressed material Z (intermediate product) during the second hot pressing, even if carbides have not been not completely eliminated, such carbides can be dissolved in a short period of time due to having a fine grain size. This thereby enables residual carbides to be eliminated.

Moreover, finer austenite grain size can be achieved by heating during the second hot pressing, making it possible to induce martensite transformation due to the fine austenite grain size, thereby enabling an ultra-high strength hot-pressed component with high toughness to be obtained.

Moreover, the hot press device 10 can be made smaller than in cases in which plural hot press machines are connected in series for sequential conveyance from heating furnace to press. This thereby enables a space saving to be achieved.

In the present exemplary embodiment, the two presses 12, 14 and the single heating furnace 18 are disposed bordering the conveyance region within which the material Z is conveyed, thereby enabling heating to be performed plural times. This thereby enables the heating furnace 18 to be commonly employed during the first heating and the second heating, enabling effective utilization of the heating furnace 18.

Note that in the present exemplary embodiment, the heating duration of the first heating and the heating duration of the second heating in the heating furnace 18 may be set separately to each other by the settings of the controller 24. This enables application to processing in which the material Z is held at a predetermined temperature for a uniform duration during the first heating, and the heated material Z is discharged without being held during the second heating.

Application may also be made to manufacture of various pressed components in which cold pressing is used in conjunction with hot pressing.

It is possible to manufacture two components on the same line by installing the presses 12, 14 with dies for different components that employ the same type and same thickness of sheet steel, with sheet steel for each component being heated alternately and allocated to the respective presses 12, 14 to perform hot pressing.

When cold pressing is performed, using the press 12 and the press 14 in sequence enables two-stage pressing in which shallow drawing is followed by deep drawing. This enables the degrees of freedom when forming to be increased. Two-stage processing in which press forming is followed by peripheral shearing is also possible. This thereby enables shapes that cannot be achieved by a single pressing to be formed.

In such cases, cold pressing does not require a heating duration, enabling application to mass production. Pre-forming methods in which heating and hot pressing are performed after cold forming are also possible.

Since there is a single heating furnace 18, the first heating and the second heating are performed alternately. However, providing multiple tiers within the furnace according to a ratio between the first heating duration and the second heating duration enables time loss to be eliminated. Namely, by loading material sequentially after a fixed period of time has elapsed during the first heating and commencing the second heating on an available tier immediately after conveyance out after the first heating enables the heating furnace 18 to be operated continuously.

Second Exemplary Embodiment

Explanation follows regarding a second exemplary embodiment of the present disclosure, with reference to the drawings.

Figure 4:
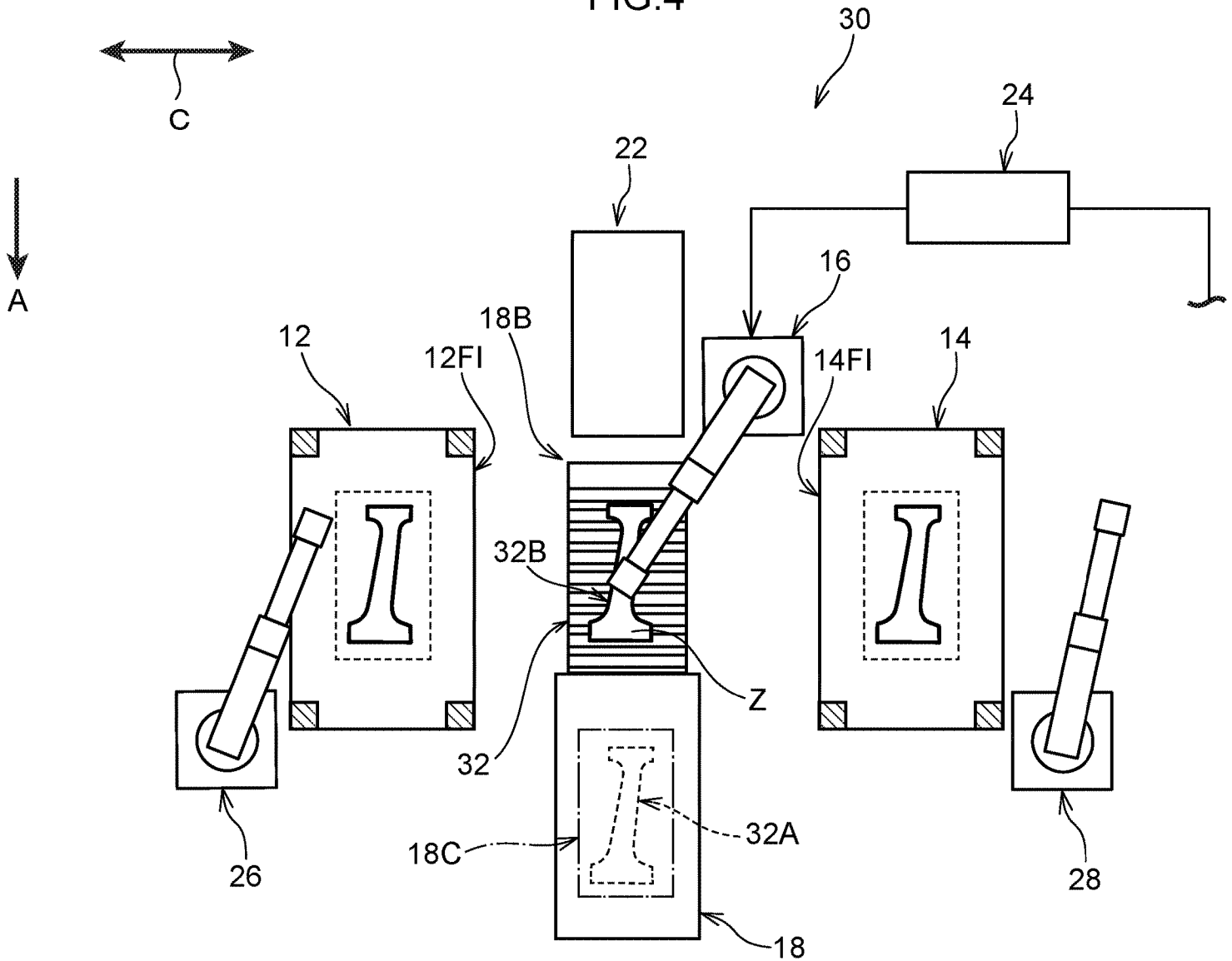
FIG. 4 is a schematic plan view illustrating a hot press device according to a second exemplary embodiment.

FIG. 4 is a diagram illustrating the second exemplary embodiment. Portions identical or equivalent to those of the first exemplary embodiment are allocated the same reference numerals, and explanation thereof is omitted, with explanation being given regarding only portions that differ.

Namely, a hot press device 30 of the present exemplary embodiment differs from the first exemplary embodiment in that the conveyance table 20 is absent.

The heating furnace 18 includes a conveyance mechanism 32 that is capable of being in a stored state 18C disposed inside the heating furnace 18, and a discharged state 18B extending to the exterior of the heating furnace 18 through the entry/exit port. When in the discharged state 18B, the conveyance mechanism 32 is disposed facing the entry/exit ports 12FI, 14FI configuring examples of insertion ports of the press 12 and the press 14, and within a conveyance range of the first manipulator 16.

Accordingly, the conveyance mechanism 32 moves the material Z between a first placement position 32A positioned inside the heating furnace 18 and a second placement position 32B positioned within the conveyance range but outside the heating furnace.

The controller 24 outputs a command to the first manipulator 16 to remove a pressed material Z from the press 12 and convey the pressed material Z to the conveyance mechanism 32 that is in the discharged state 18B, namely to the second placement position 32B.

In the present exemplary embodiment, the material Z is removed from the press 12 and conveyed to the conveyance mechanism 32 that is in the discharged state 18B by the first manipulator 16, enabling the heating furnace 18 to place the conveyance mechanism 32 in the stored state 18C to heat the material Z quickly while on the conveyance mechanism 32.

After heating, the heating furnace 18 places the conveyance mechanism 32 in the discharged state 18B, enabling the heated material Z on the conveyance mechanism 32 to be disposed in the conveyance range of the first manipulator 16 quickly. This thereby enables the interaction between the material Z and the heating furnace 18 to be simplified and performed smoothly.

The conveyance mechanism 32 is disposed facing the entry/exit ports 12FI, 14FI of the press 12 and the press 14 when in the discharged state 18B. This thereby enables the presses 12, 14 and the conveyance mechanism 32 to be linked by the shortest possible path, enabling the time taken for insertion and removal of the material Z to be reduced.

Third Exemplary Embodiment

Explanation follows regarding a third exemplary embodiment of the present disclosure, with reference to the drawings.

Figure 5:
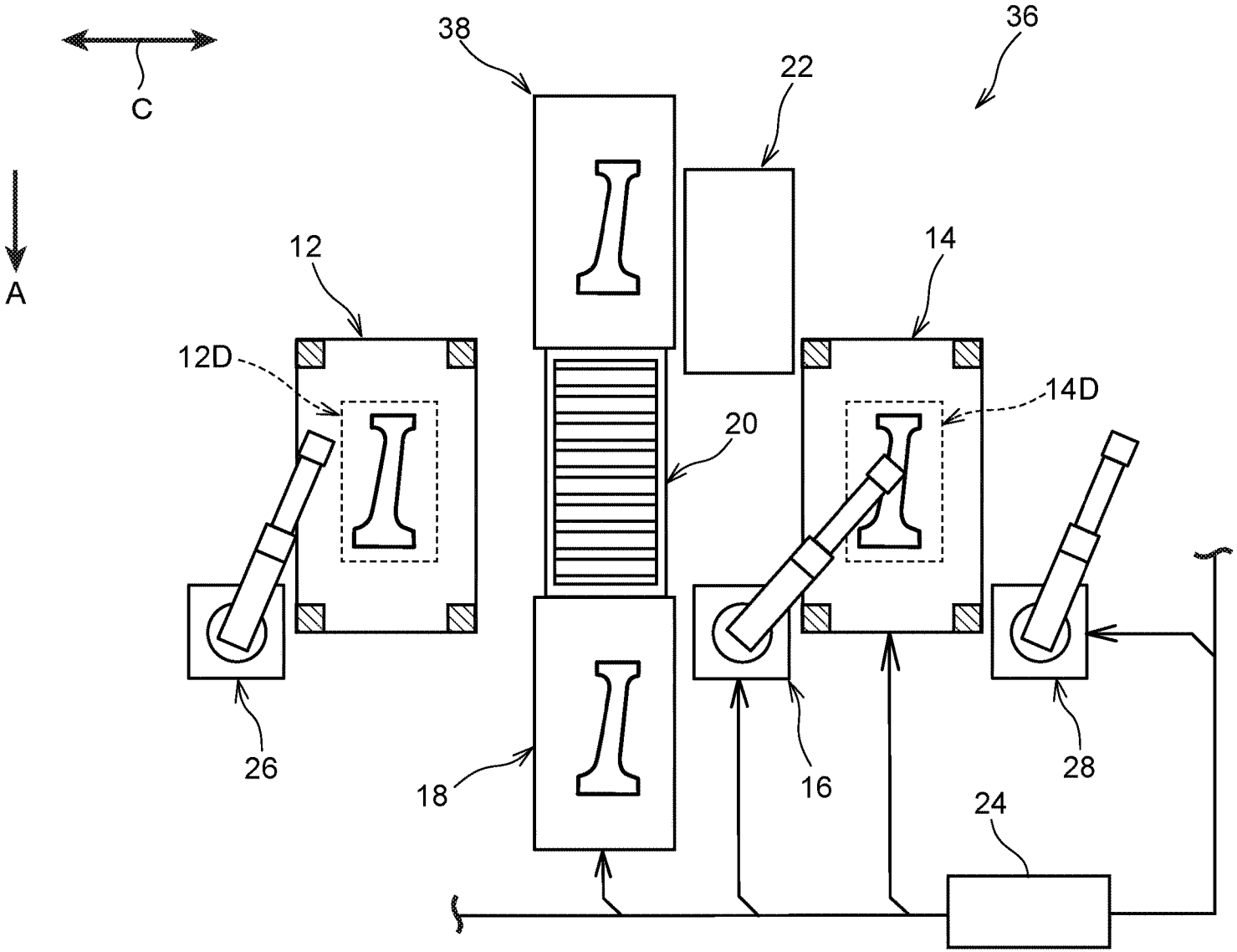
FIG. 5 is a schematic plan view illustrating a hot press device according to a third exemplary embodiment.

FIG. 5 is a diagram illustrating a hot press device 36 of the present exemplary embodiment. Portions identical or equivalent to those of the first exemplary embodiment are allocated the same reference numerals, and explanation thereof is omitted, with explanation being given regarding only portions that differ.

The hot press device 36 of the present exemplary embodiment differs greatly from that of the first exemplary embodiment in that a second heating furnace 38 is provided in addition to the heating furnace 18 (this will be referred to as the first heating furnace 18 in the present exemplary embodiment).

Namely, the first heating furnace 18 is provided at one end side of the conveyance table 20, and the second heating furnace 38 is provided at the other end side of the conveyance table 20. Accordingly, the hot press device 36 according to the present exemplary embodiment is provided with two or more heating furnaces, this being equal to or fewer than the number of the presses 12, 14.

The material table 22 is disposed on the press 14 side of the second heating furnace 38, and the first manipulator 16 is disposed between the first heating furnace 18 and the press 14. The presses 12, 14, the heating furnaces 18, 38, and the tables 20, 22 are provided within the conveyance range of the first manipulator 16.

Explanation follows regarding operation of the present exemplary embodiment configured as described above. Note that similarly to in the first exemplary embodiment, the manipulators 16, 26, 28, the presses 12, 14, the heating furnaces 18, 38, and so on are operated according to commands from the controller 24. Explanation regarding the commands from the controller 24 is omitted.

Namely, the first manipulator 16 holds a material Z (blank) that has been placed on the material table 22 with the suction holding mechanism and conveys the material Z (blank) to the conveyance table 20.

The material Z (blank) that has been conveyed to the conveyance table 20 is loaded into the first heating furnace 18 by driving the rollers described above. The first heating furnace 18 heats the material Z (blank) at a set temperature (for example approximately 900° C.) for a set duration (for example 4 minutes), after which the material Z (blank) is discharged onto the conveyance table 20 by driving the rollers.

The material Z (heated blank) that has been discharged onto the conveyance table 20 is held and lifted up by the hooking holding mechanism of the first manipulator 16, and is set on the lower die 12D of the press 12.

The press 12 lowers the upper die 12C to press form the material Z (heated blank) clamped between the upper die 12C and the lower die 12D. When this is performed, the heat of the material Z (heated blank) is rapidly removed by the upper die 12C and the lower die 12D. The heat removal amount is particularly large when the dies reach bottom dead center and the material Z is held clamped between the upper die 12C and the lower die 12D. This corresponds to a first hot pressing.

The time taken from discharging the material Z (heated blank) from the first heating furnace 18 to holding the material Z (heated blank) clamped between the upper die 12C and the lower die 12D is managed. The time is, for example, approximately 8 seconds.

Note that in the present exemplary embodiment, the material Z (heated blank) discharged onto the conveyance table 20 is set in the press 12 by the first manipulator 16; however, there is no limitation thereto. A linear conveyance mechanism (not illustrated in the drawings) may be provided between the conveyance table 20 and the press 12 such that the material Z (heated blank) discharged onto the conveyance table 20 from the first heating furnace 18 is set in the press 12 at high speed using the linear conveyance mechanism, thereby achieving an increase in speed and a reduction in the time taken.

The material Z (heated blank) is pressed so as to be held and cooled continuously for a predetermined pressing duration (for example 10 seconds) by the press 12, after which the upper die 12C is raised and the press 12 is opened. The lifting mechanism (not illustrated in the drawings) of the press 12 lifts up and releases the pressed material Z (intermediate product) from the lower die 12D.

The first manipulator 16 uses the hooking holding mechanism to lift up and convey the pressed material Z (intermediate product) from the lower die 12D to the conveyance table 20. The material Z (intermediate product) conveyed to the conveyance table 20 is loaded into the second heating furnace 38 by driving the rollers of the conveyance table 20.

The second heating furnace 38 reheats the material Z (intermediate product) loaded therein, and after reaching a reheat temperature (for example 400° C.), the material (intermediate product) is held at the reheat temperature for a predetermined duration (for example 60 minutes). The material Z (heated intermediate product) is then discharged onto the conveyance table 20 by driving the rollers described above.

When this is performed, the time taken for the material Z (heated intermediate product) to enter or leave the second heating furnace 38 is set to within approximately 2 seconds for a material with a length of 1.5 m in the insertion direction (i.e at a conveyance speed of at least 750 mm/s).

The material Z (heated intermediate product) discharged onto the conveyance table 20 is held by the hooking holding mechanism of the first manipulator 16. When this is performed, the controller 24 computes a position to hook the material Z (heated intermediate product) with the hooking holding mechanism in consideration of the amount of thermal expansion of the material Z (heated intermediate product), and outputs a control signal to the first manipulator 16. The first manipulator 16 sets the lifted material Z (heated intermediate product) on the lower die 14D of the press 14.

The press 14 lowers the upper die 14C to press form the material Z (heated intermediate product) clamped between the upper die 14C and the lower die 14D. When this is performed, the heat of the material Z (heated intermediate product) is rapidly removed by the upper die 14C and the lower die 14D. The heat removal amount is large when the material Z is held clamped between the upper die 14C and the lower die 14D. This corresponds to a second hot pressing.

The time taken from discharging the material Z (heated intermediate product) from the second heating furnace 38 to holding the material Z (heated intermediate product) clamped between the upper die 14C and the lower die 14D is managed. The time is, for example, approximately 6 seconds.

Note that in the present exemplary embodiment, the material Z (heated intermediate product) discharged onto the conveyance table 20 is set in the press 14 by the first manipulator 16; however, there is no limitation thereto. A linear conveyance mechanism (not illustrated in the drawings) may be provided between the conveyance table 20 and the press 14 such that the material Z (heated intermediate product) discharged onto the conveyance table 20 from the second heating furnace 38 is set in the press 14 at high speed using the linear conveyance mechanism, thereby achieving an increase in speed and a reduction in the time taken.

When cooling during the second hot pressing, martensite transformation does not occur. The protruding die (punch) and the recessed die (die) corresponding to the protruding die configuring the dies are thus greater in size than the finished product in consideration of the contraction of the material Z (heated intermediate product) during cooling.

The material Z (heated intermediate product) is pressed so as to be held and cooled continuously for a predetermined pressing duration (for example 15 seconds) by the press 14, after which the upper die 14C is raised and the press 14 is opened. The lifting mechanism (not illustrated in the drawings) of the press 14 lifts up and releases the pressed material Z (formed product) from the lower die 14D. The third manipulator 28 then lifts up and conveys the material Z (formed product) from the lower die 14D to be passed to a subsequent process.

Note that in the present exemplary embodiment, the cycle time is approximately 65 minutes per component when the two heating durations and conveyance durations are added together.

In this manner, the hot press device 36 of the present exemplary embodiment is capable of exhibiting similar operation and advantageous effects to those of the first exemplary embodiment.

Moreover, the present exemplary embodiment includes the first heating furnace 18 that heats the material Z to be pressed by the press 12 and the second heating furnace 38 that heats the material Z to be pressed by the press 14, enabling the material Z to be heated by dedicated furnaces in the first hot pressing and the second hot pressing. This thereby enables optimal temperature management in the respective hot pressings, facilitating quality control of the formed product.

Note that in the present exemplary embodiment, the second heating duration is longer than the first heating duration, resulting in unproductive time in the first heating furnace 18. In order to eliminate this issue, the second heating furnace 38 may be configured by a multi-tiered or rotating heating furnace.

In such cases, a configuration is adopted in which a number of sheets of the material Z corresponding to the ratio of the second heating duration to the first heating duration (60 minutes/4 minutes=15 sheets in the present exemplary embodiment) can be heated in the second heating furnace 38. This enables the heating durations to be synchronized for the first heating and the second heating, and for unproductive time to be kept to a minimum. In order to achieve further improvements in productivity above those from synchronizing operation of the heating furnaces in this manner, multiples of N times the number of tiers of heating furnaces, or multiples of N times the length for rotating furnaces, may be employed.

In the present exemplary embodiment, dies for different components may be installed in the presses 12, 14, and materials Z (blanks) for different components or made of different types of steel may be introduced to the first and second heating furnaces 18, 38 at staggered timings for hot pressing in the corresponding presses 12, 14. This thereby enables two different components to be manufactured on the same line.

Providing the first and second heating furnaces 18, 38 enables plural components using materials Z of different types and different thicknesses to be manufactured concurrently under different heating conditions.

Fourth Exemplary Embodiment

Explanation follows regarding a fourth exemplary embodiment of the present disclosure, with reference to the drawings.

Figure 6:
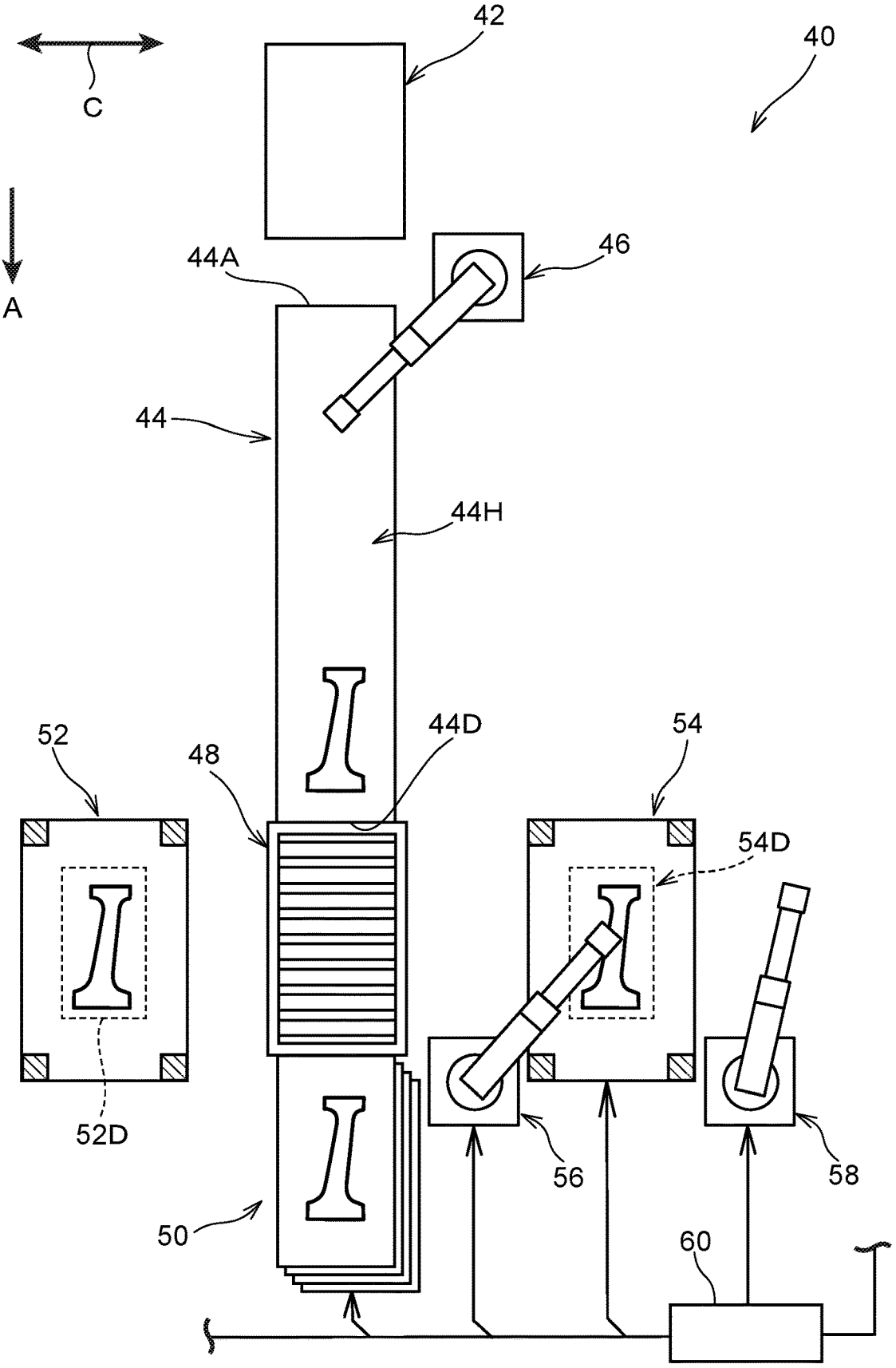
FIG. 6 is a schematic plan view illustrating a hot press device according to a fourth exemplary embodiment.

FIG. 6 is a diagram illustrating a hot press device 40 according to the present exemplary embodiment, in which a material table 42 is provided on the conveyance direction upstream side of the material Z being processed. A continuous roller hearth heating furnace 44, this being an example of a heating furnace and configuring part of a conveyance device, is provided on the downstream side of the material table 42. A first manipulator 46 serving as an example of a conveyance device that conveys the material Z on the material table 42 to an insertion port 44A of the continuous roller hearth heating furnace 44 is provided between the material table 42 and the continuous roller hearth heating furnace 44.

Figure 7:
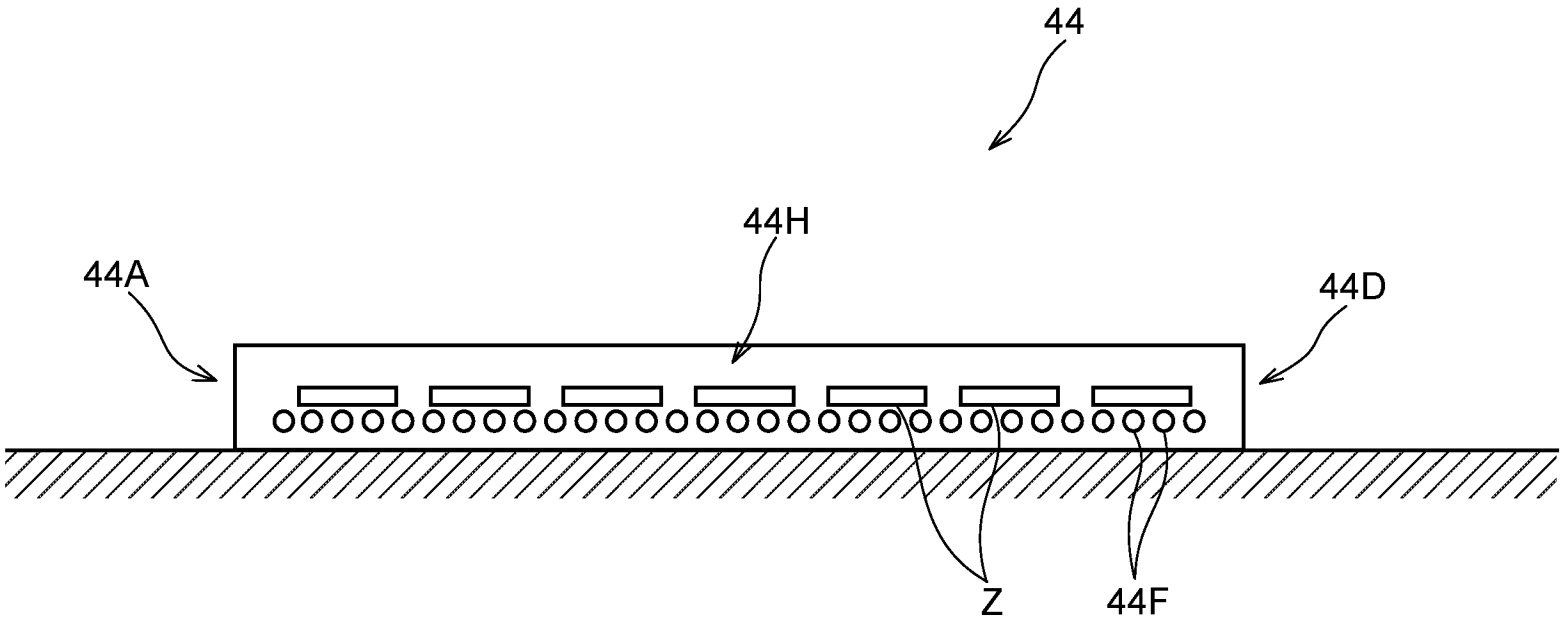
FIG. 7 is an explanatory diagram illustrating a continuous roller hearth heating furnace.

As illustrated in FIG. 7, the continuous roller hearth heating furnace 44 includes rollers 44F that convey the material Z inserted through the insertion port 44A toward a discharge port 44D. The continuous roller hearth heating furnace 44 heats the material Z as the material Z is being carried from the upstream side toward the downstream side by the rollers 44F.

The continuous roller hearth heating furnace 44 thereby includes an in-furnace conveyance section 44H that conveys the material Z from the insertion port 44A toward the discharge port 44D.

As illustrated in FIG. 6, a conveyance table 48 is provided on the downstream side of the continuous roller hearth heating furnace 44. The material Z discharged through the discharge port 44D of the continuous roller hearth heating furnace 44 can be placed on the conveyance table 48.

Figure 8:
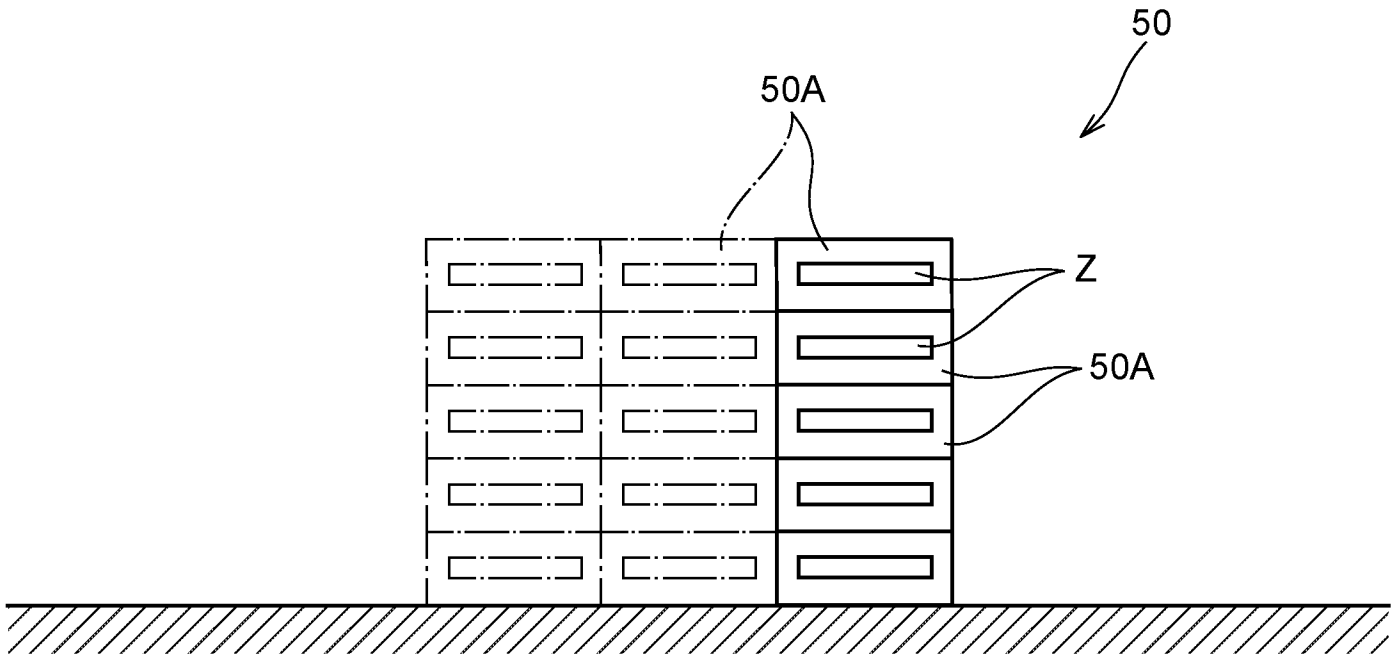
FIG. 8 is an explanatory diagram illustrating a multi-tiered heating furnace.

A multi-tiered heating furnace 50 is provided downstream of the conveyance table 48. As illustrated in FIG. 8, the multi-tiered heating furnace 50 is provided with plural heating chambers 50A in a row along a vertical direction. Each of the heating chambers 50A can be raised and lowered, and an entry/exit port of each of the heating chambers 50A is capable of being raised and lowered to draw level with the conveyance table 48. This enables the duration of an insertion or discharge operation of the material Z to be made the same for each tier.

Plural sheets of the material Z are heated in the respective heating chambers 50A, and the duration from being loaded in the heating chamber 50A to being removed from the heating chamber 50A is adjusted, enabling the heating duration of each sheet of the material Z to be controlled.

Note that as illustrated by the dotted lines in FIG. 8, in the multi-tiered heating furnace 50, additional heating chambers 50A can be disposed in the lateral direction such that plural of the heating chambers 50A are disposed in both the vertical and lateral directions.

As illustrated in FIG. 6, a press 52 is disposed on one side of the conveyance table 48, and a press 54 is disposed on the other side of the conveyance table 48.

A second manipulator 56 that links the continuous roller hearth heating furnace 44, the conveyance table 48, the press 52, the press 54, and the multi-tiered heating furnace 50 together is provided in the vicinity of a corner on the conveyance table 48 side of the press 54. The discharge port 44D of the continuous roller hearth heating furnace 44, the conveyance table 48, the press 52, the press 54, and the multi-tiered heating furnace 50 are disposed within the conveyance range of the material Z by the second manipulator 56.

The presses 52, 54, the continuous roller hearth heating furnace 44, and the multi-tiered heating furnace 50 are disposed bordering the conveyance table 48. The press 52 and the press 54 oppose each other. The continuous roller hearth heating furnace 44 and the multi-tiered heating furnace 50 also oppose each other. This enables the material Z to be moved between the continuous roller hearth heating furnace 44 and the press 52, and between the multi-tiered heating furnace 50 and the press 54, using the second manipulator 56.

A third manipulator 58 is provided in the vicinity of a corner on the opposite side of the press 54 to the conveyance table 48. The third manipulator 58 discharges the material Z that has been pressed by the press 54.

Note that the conveyance table 48, the presses 52, 54, and the manipulators 46, 56, 58 are similar in structure to their equivalents in the first exemplary embodiment.

Explanation follows regarding operation of the present exemplary embodiment configured as described above. Namely, the manipulators 46, 56, 58, the presses 52, 54, the heating furnaces 44, 50, and so on are operated according to commands from a controller 60, similarly to in the first exemplary embodiment. Explanation regarding the commands from the controller 60 will be omitted.

The first manipulator 46 holds the material Z (blank) that has been placed on the material table 42 with the suction holding mechanism, and conveys the material Z (blank) to the insertion port 44A of the continuous roller hearth heating furnace 44 at a fixed time interval.

The material Z (blank) is heated while being moved through the inside of the continuous roller hearth heating furnace 44 by driving the rollers, and is discharged through the discharge port 44D to the conveyance table 48 after a predetermined duration (for example 4 minutes) has elapsed from the material Z (blank) reaching a predetermined temperature (for example 1000° C.).

The material Z (heated blank) that has been discharged onto the conveyance table 48 is held and lifted up by the hooking holding mechanism of the second manipulator 56 and set on a lower die 52D of the press 52.

The press 52 lowers its upper die to press form the material Z (heated blank) clamped between the upper die and the lower die 52D. When this is performed, the heat of the material Z (heated blank) is rapidly removed by the upper die and the lower die 52D. The heat removal amount is particularly large when the dies reach bottom dead center and the material Z is held clamped between the upper die and the lower die 52D. This corresponds to a first hot pressing.

The time taken from discharging the material Z (heated blank) from the continuous roller hearth heating furnace 44 to holding the material Z (heated blank) clamped between the upper die and the lower die 52D is managed. The time is, for example, approximately 8 seconds.

Note that in the present exemplary embodiment, the material Z (heated blank) discharged onto the conveyance table 48 is set in the press 52 by the second manipulator 56; however, there is no limitation thereto. A linear conveyance mechanism (not illustrated in the drawings) may be provided between the conveyance table 48 and the press 52 such that the material Z (heated blank) discharged onto the conveyance table 48 from the continuous roller hearth heating furnace 44 is set in the press 52 at high speed using the linear conveyance mechanism, thereby achieving an increase in speed and a reduction in the time taken.

The material Z (heated blank) is pressed so as to be held and cooled continuously for a predetermined pressing duration (for example 10 seconds) by the press 52, after which the upper die is raised and the press 52 is opened. A lifting mechanism (not illustrated in the drawings) of the press 52 lifts up and releases the pressed material Z (intermediate product) from the lower die 52D.

When this is performed, the second manipulator 56 lifts up and conveys the pressed material Z (intermediate product) from the lower die 52D to the conveyance table 48 using the hooking holding mechanism. The material Z (intermediate product) that has been conveyed to the conveyance table 48 is loaded into a selected heating chamber 50A of the multi-tiered heating furnace 50 by driving rollers of the conveyance table 48. When this is performed, when loading the material Z (intermediate product) into a heating chamber 50A for which the conveyance table 48 is unable to perform the loading operation, the loading operation is performed by the second manipulator 56.

In the heating chamber 50A, the loaded material Z (intermediate product) is reheated, and after reaching a reheat temperature (for example 900° C.), the material Z (intermediate product) is held at the reheat temperature for a predetermined duration (for example 2 minutes). The material Z (heated intermediate product) is then discharged onto the conveyance table 48 by driving the rollers described above. When this is performed, in cases in which the material Z (heated intermediate product) cannot be discharged onto the conveyance table 48 directly, the discharge operation is performed by the second manipulator 56. Note that the time taken for the material Z (heated intermediate product) to enter or leave the multi-tiered heating furnace 50 is set to within approximately 2 seconds for a material with a length of 1.5 m in the insertion direction (i.e. a conveyance speed of at least 750 mm/s).

The material Z (heated intermediate product) discharged onto the conveyance table 48 is held by the second manipulator 56 using the hooking holding mechanism. When this is performed, the controller 60 computes a position to hook the material Z (heated intermediate product) with the hooking holding mechanism in consideration of the amount of thermal expansion of the material Z (heated intermediate product), and outputs a control signal to the second manipulator 56. The second manipulator 56 sets the lifted material Z (heated intermediate product) on a lower die 54D of the press 54.

The press 54 lowers its upper die to press form the material Z (heated intermediate product) clamped between the upper die and the lower die 54D. When this is performed, the heat of the material Z (heated intermediate product) is rapidly removed by the upper die and the lower die 54D. The heat removal amount is particularly large when the dies reach bottom dead center and the material Z is held clamped between the upper die and the lower die 54D. This corresponds to a second hot pressing.

The time taken from discharging the material Z (heated intermediate product) from the multi-tiered heating furnace 50 to holding the material Z (heated intermediate product) clamped between the upper die and the lower die 54D is managed. The time is, for example, approximately 6 seconds.

Note that in the present exemplary embodiment, the material Z (heated intermediate product) discharged onto the conveyance table 48 is set in the press 54 by the second manipulator 56; however, there is no limitation thereto. A linear conveyance mechanism (not illustrated in the drawings) may be provided between the conveyance table 48 and the press 54 such that the material Z (heated intermediate product) discharged onto the conveyance table 48 from the multi-tiered heating furnace 50 is set in the press 54 at high speed using the linear conveyance mechanism, thereby achieving an increase in speed and a reduction in the time taken.

The material Z (heated intermediate product) is pressed so as to be held and cooled continuously for a predetermined pressing duration (for example 15 seconds) by the press 54, after which the upper die is raised and the press 54 is opened. A lifting mechanism (not illustrated in the drawings) of the press 54 lifts up and releases the pressed material Z (formed product) from the lower die 54D. The third manipulator 58 then lifts up and conveys the material Z (formed product) from the lower die 54D to be passed to a subsequent process.

In this manner, the hot press device 40 of the present exemplary embodiment is capable of exhibiting similar operation and advantageous effects to those of the first exemplary embodiment and the third exemplary embodiment.

Note that in the present exemplary embodiment, the first heating duration by the continuous roller hearth heating furnace 44 is twice the length of the second heating duration by the multi-tiered heating furnace 50. Accordingly, the processing amounts thereof may be synchronized by setting approximately twice as many sheets in the continuous roller hearth heating furnace 44 as in the multi-tiered heating furnace 50.

This configuration also enables efficient processing when using a heating pattern in which during the first heating the material Z is held for a predetermined duration after reaching a predetermined temperature, and during the second heating the material Z is discharged without being held for a predetermined duration after reaching a predetermined temperature. This configuration is thus well-suited to such a production method.

When forming a formed product using a conventional hot press, it is possible to produce two different components separately at the same time. Moreover, although doing so would require time for a second round of heat treatment, processing that includes tempering can also be accommodated.

Fifth Exemplary Embodiment

Explanation follows regarding a fifth exemplary embodiment of the present disclosure, with reference to the drawings.

Figure 9:
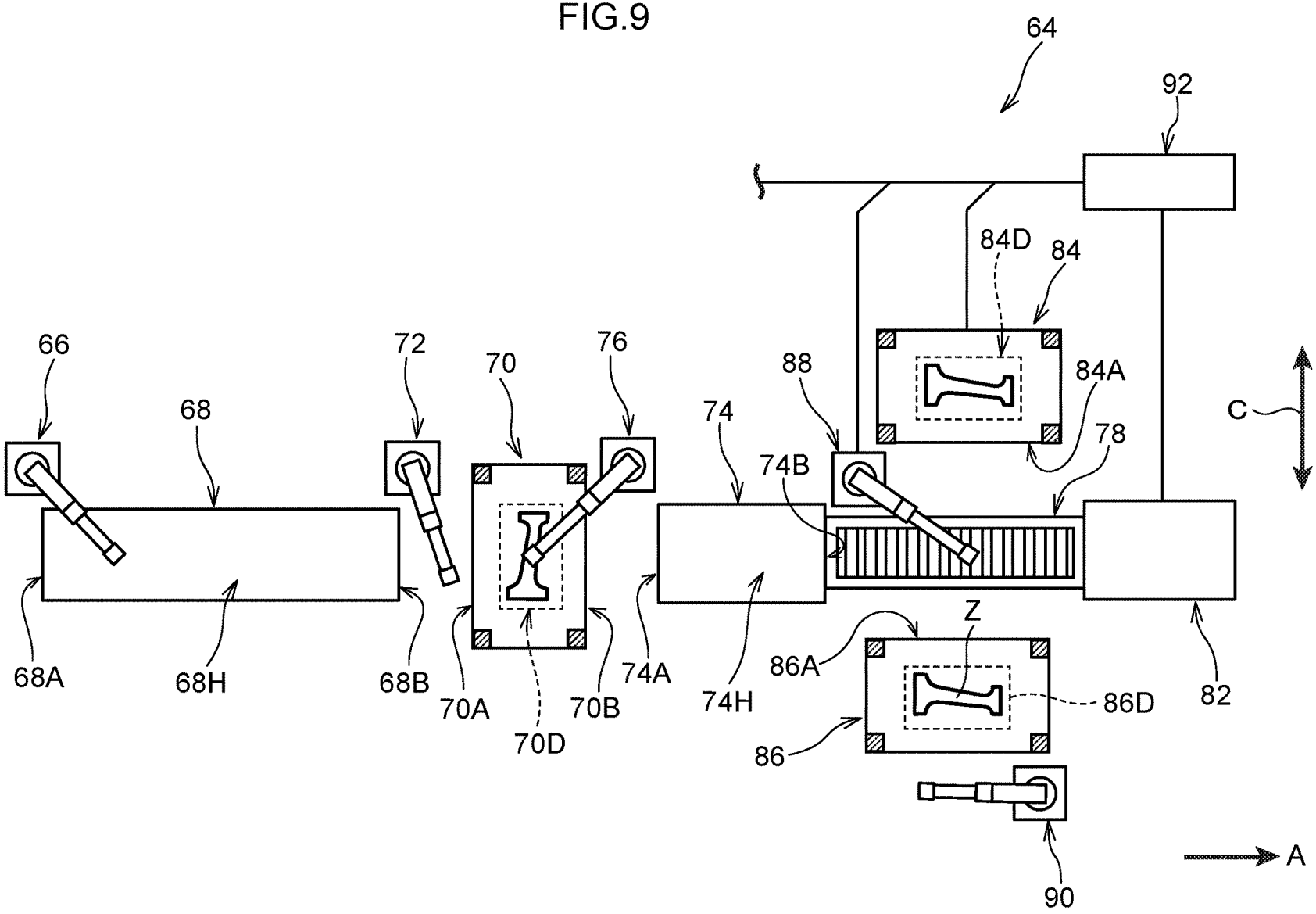
FIG. 9 is a schematic plan view illustrating a hot press device according to a fifth exemplary embodiment.

FIG. 9 is a diagram illustrating a hot press device 64 according to the present exemplary embodiment. A first manipulator 66 serving as an example of a conveyance device is provided on a conveyance direction upstream side of the material Z for processing, and a continuous roller hearth heating furnace 68 configuring part of the conveyance device and serving as an example of a heating furnace is provided alongside the first manipulator 66.

A press 70 is provided on a downstream side of the continuous roller hearth heating furnace 68. An insertion port 70A of the press 70 is disposed facing a discharge port 68B of the continuous roller hearth heating furnace 68. A second manipulator 72 serving as an example of a conveyance device linking the continuous roller hearth heating furnace 68 and the press 70 together is provided alongside the continuous roller hearth heating furnace 68 and between the continuous roller hearth heating furnace 68 and the press 70. The discharge port 68B of the continuous roller hearth heating furnace 68 and the insertion port 70A of the press 70 are provided within a conveyance range of the material Z by the second manipulator 72.

The continuous roller hearth heating furnace 68 is configured similarly to that of the fourth exemplary embodiment, and conveys the material Z inserted through an insertion port 68A toward the discharge port 68B while progressively heating the material Z. An in-furnace conveyance section 68H of the continuous roller hearth heating furnace 68 that conveys the material Z from the insertion port 68A to the discharge port 68B is configured by a roller mechanism, and configures part of a conveyance path.

A roller hearth heating furnace 74 serving as an example of a heating furnace and configuring part of a conveyance device is provided on a downstream side of the press 70, and a removal port 70B of the press 70 and an insertion port 74A of the roller hearth heating furnace 74 are disposed so as to oppose each other.

Similarly to the continuous roller hearth heating furnace 68, the roller hearth heating furnace 74 also conveys the material Z inserted through the insertion port 74A toward a discharge port 74B while heating the material Z. An in-furnace conveyance section 74H of the roller hearth heating furnace 74 that conveys the material Z from the insertion port 74A to the discharge port 74B is configured by a roller mechanism, and configures part of a conveyance path.

A third manipulator 76 serving as an example of a conveyance device linking the press 70 and the roller hearth heating furnace 74 together is provided alongside the roller hearth heating furnace 74. The removal port 70B of the press 70 and the insertion port 74A of the roller hearth heating furnace 74 are provided within a conveyance range of the material Z by the third manipulator 76.

A conveyance table 78 is provided on a downstream side of the roller hearth heating furnace 74. The material Z discharged through a discharge port 74B of the roller hearth heating furnace 74 is capable of being placed on the conveyance table 78.

A multi-tiered heating furnace 82 is provided on a downstream side of the conveyance table 78. The structure of the multi-tiered heating furnace 82 is similar to that of the fourth exemplary embodiment.

A press 84 is provided on one side of the conveyance table 78. An entry/exit port 84A for the material Z to and from the press 84 is provided on the conveyance table 78 side of the press 84. A press 86 is provided on the other side of the conveyance table 78. An entry/exit port 86A for the material Z to and from the press 86 is provided on the conveyance table 78 side of the press 86.

A fourth manipulator 88 linking the roller hearth heating furnace 74, the conveyance table 78, the press 84, the press 86, and the multi-tiered heating furnace 82 together is provided in the vicinity of a corner on the conveyance table 78 side of the press 84. The discharge port 74B of the roller hearth heating furnace 74, the conveyance table 78, the press 84, the press 86, and the multi-tiered heating furnace 82 are disposed within a conveyance range of the material Z by the fourth manipulator 88.

The presses 84, 86 and the heating furnaces 74, 82 are disposed bordering the conveyance table 78. The press 84 and the press 86 oppose each other, and the roller hearth heating furnace 74 and the multi-tiered heating furnace 82 oppose each other. The material Z can accordingly be moved between the roller hearth heating furnace 74 and the press 84, and between the multi-tiered heating furnace 82 and the press 86, by the fourth manipulator 88.

A fifth manipulator 90 is provided in the vicinity of a corner on the press 86, enabling the material Z that has been pressed by the press 86 to be removed.

Note that the conveyance table 78, the presses 70, 84, 86, and the manipulators 66, 72, 76, 88, 90 have similar structures to their equivalents in the first exemplary embodiment.

Explanation follows regarding operation of the present exemplary embodiment configured as described above. Note that the manipulators 66, 72, 76, 88, 90, the presses 70, 84, 86, the heating furnaces 68, 74, 82, and the like are operated in response to commands from a controller 92, similarly to in the first exemplary embodiment. Explanation regarding the commands from the controller 92 will be omitted.

The first manipulator 66 holds the material Z (blank) that has for example been placed on a material table with the suction holding mechanism, and conveys the material Z (blank) through the insertion port 68A of the continuous roller hearth heating furnace 68 at a fixed time interval.

The material Z (blank) is heated while being moved through the inside of the continuous roller hearth heating furnace 68 by driving the rollers. The material Z (blank) is then conveyed through the discharge port 68B to the press 70 and set on a lower die 70D by the second manipulator 72 after a predetermined duration (for example 4 minutes) has elapsed from the material Z (blank) reaching a predetermined temperature (for example 1000° C.).

The press 70 lowers its upper die to press form the material Z (heated blank) clamped between the upper die and the lower die 70D. When this is performed, the heat of the material Z (heated blank) is rapidly removed by the upper die and the lower die 70D. The heat removal amount is particularly large when the dies reach bottom dead center and the material Z is held clamped between the upper die and the lower die 70D. This corresponds to a first hot pressing.

The time taken from discharging the material Z (heated blank) from the continuous roller hearth heating furnace 68 to holding the material Z (heated blank) clamped between the upper die and the lower die 70D is managed. The time is, for example, approximately 8 seconds.

The material Z (heated blank) is pressed so as to be held and cooled continuously for a predetermined pressing duration (for example 10 seconds) by the press 70, after which the upper die is raised and the press 70 is opened. A lifting mechanism (not illustrated in the drawings) of the press 70 lifts up and releases the pressed material Z (primary intermediate product) from the lower die 70D. The third manipulator 76 then lifts up and conveys the pressed material Z (primary intermediate product) from the lower die 70D to the insertion port 74A of the roller hearth heating furnace 74 using the hooking holding mechanism.

The material Z (primary intermediate product) is moved through the inside of the roller hearth heating furnace 74 for 2 minutes by driving the rollers until it reaches a predetermined temperature (for example 900° C.), before being discharged through the discharge port 74B to the conveyance table 78.

The material Z (heated primary intermediate product) discharged onto the conveyance table 78 is held and lifted up by the fourth manipulator 88 using the hooking holding mechanism, and is set on a lower die 84D of the press 84.

The press 84 lowers its upper die to press form the material Z (heated primary intermediate product) clamped between the upper die and the lower die 84D. When this is performed, the heat of the material Z (heated primary intermediate product) is rapidly removed by the upper die and the lower die 84D. The heat removal amount is particularly large when the dies reach bottom dead center and the material Z is held clamped between the upper die and the lower die 84D. This corresponds to a second hot pressing.

The time taken from discharging the material Z (heated primary intermediate product) from the roller hearth heating furnace 74 to holding the material Z (heated primary intermediate product) clamped between the upper die and the lower die 84D is managed. The time is, for example, approximately 8 seconds.

Note that in the present exemplary embodiment, the material Z (heated primary intermediate product) discharged onto the conveyance table 78 is set in the press 84 by the fourth manipulator 88; however, there is no limitation thereto. A linear conveyance mechanism (not illustrated in the drawings) may be provided between the conveyance table 78 and the press 84 such that the material Z (heated primary intermediate product) discharged onto the conveyance table 78 from the roller hearth heating furnace 74 is set in the press 84 at high speed using the linear conveyance mechanism, thereby achieving an increase in speed and a reduction in the time taken.

The material Z (heated primary intermediate product) is pressed so as to be held and cooled continuously for a predetermined pressing duration (for example 10 seconds) by the press 84, after which the upper die is raised. The fourth manipulator 88 lifts up and releases the pressed material Z (secondary intermediate product) from the lower die 84D using the hooking holding mechanism, and conveys the pressed material Z (secondary intermediate product) to the conveyance table 78.

The material Z (secondary intermediate product) conveyed to the conveyance table 78 is loaded in a selected heating chamber of the multi-tiered heating furnace 82 by driving rollers of the conveyance table 78. When this is performed, when loading the material Z (secondary intermediate product) in a heating chamber for which the conveyance table 78 is unable to perform the loading operation, the loading operation is performed by the fourth manipulator 88.

In the heating chamber, the loaded material Z (secondary intermediate product) is reheated, and after reaching a reheat temperature (for example 400° C.), the material Z (secondary intermediate product) is heated at the reheat temperature for a predetermined duration (for example 60 minutes). The material Z (heated secondary intermediate product) is then discharged onto the conveyance table 78 by driving the rollers described above. When this is performed, in cases in which the material Z (heated secondary intermediate product) cannot be discharged onto the conveyance table 78 directly, the discharge operation is performed by the fourth manipulator 88. Note that the time taken for the material Z (heated secondary intermediate product) to enter or leave the multi-tiered heating furnace 82 is set to within approximately 2 seconds for a material with a length of 1.5 m in the insertion direction (i.e. a conveyance speed of at least 750 mm/s).

The material Z (heated secondary intermediate product) discharged onto the conveyance table 78 is held by the fourth manipulator 88 using the hooking holding mechanism. When this is performed, the controller 92 computes a position to hook the material Z (heated secondary intermediate product) with the hooking holding mechanism in consideration of the amount of thermal expansion of the material Z (heated secondary intermediate product, and outputs a control signal to the fourth manipulator 88. The fourth manipulator 88 sets the lifted material Z (heated secondary intermediate product) on a lower die 86D of the press 86.

The press 86 lowers its upper die to press form the material Z (heated secondary intermediate product) clamped between the upper die and the lower die 86D. When this is performed, the heat of the material Z (heated secondary intermediate product) is rapidly removed by the upper die and the lower die 86D. The heat removal amount is particularly large when the dies reach bottom dead center and the material Z is held clamped between the upper die and the lower die 86D. This corresponds to a third hot pressing.

The time taken from discharging the material Z (heated secondary intermediate product) from the multi-tiered heating furnace 82 to holding the material Z (heated secondary intermediate product) clamped between the upper die and the lower die 86D is managed. The time is, for example, approximately 6 seconds.

In the present exemplary embodiment, the material Z (heated secondary intermediate product) discharged onto the conveyance table 78 is set in the press 86 by the fourth manipulator 88; however, there is no limitation thereto. A linear conveyance mechanism (not illustrated in the drawings) may be provided between the conveyance table 78 and the press 86 such that the material Z (heated secondary intermediate product) discharged onto the conveyance table 78 from the multi-tiered heating furnace 82 is set in the press 86 at high speed using the linear conveyance mechanism, thereby achieving an increase in speed and a reduction in the time taken.

When cooling during the third hot pressing, martensite transformation does not occur. The protruding die (punch) and the recessed die (die) corresponding to the protruding die that configure the dies of the press 86 are thus greater in size than the finished product in consideration of the contraction of the material Z (heated secondary intermediate product) during cooling.

The material Z (heated secondary intermediate product) is pressed so as to be held and cooled continuously for a predetermined pressing duration (for example 15 seconds) by the press 86, after which the upper die is raised and the press 86 is opened. A lifting mechanism (not illustrated in the drawings) of the press 86 lifts up and releases the pressed material Z (formed product) from the lower die 86D. The fifth manipulator 90 then lifts up and conveys the material Z (formed product) from the lower die 86D to be passed to a subsequent process.

In this manner, the hot press device 64 of the present exemplary embodiment is capable of exhibiting similar operation and advantageous effects to those of the first exemplary embodiment and the third exemplary embodiment.

Moreover, the configuration of the present exemplary embodiment is well-suited to extending a conventional hot press apparatus line so as to include multiple heat treatment and hot pressing processes.

Application may be made to a conventional hot press apparatus line combining normal hot pressing and plural rounds of cold pressing. A third round of heat treatment in which a second round of quenching and tempering are combined is also possible. In such cases, the configuration has excellent potential for extension since it is possible to provide additional tiers in multi-tiered heating furnaces for tempering, which requires a longer processing time.

Sixth Exemplary Embodiment

Explanation follows regarding a sixth exemplary embodiment of the present disclosure, with reference to the drawings.

Figure 10:
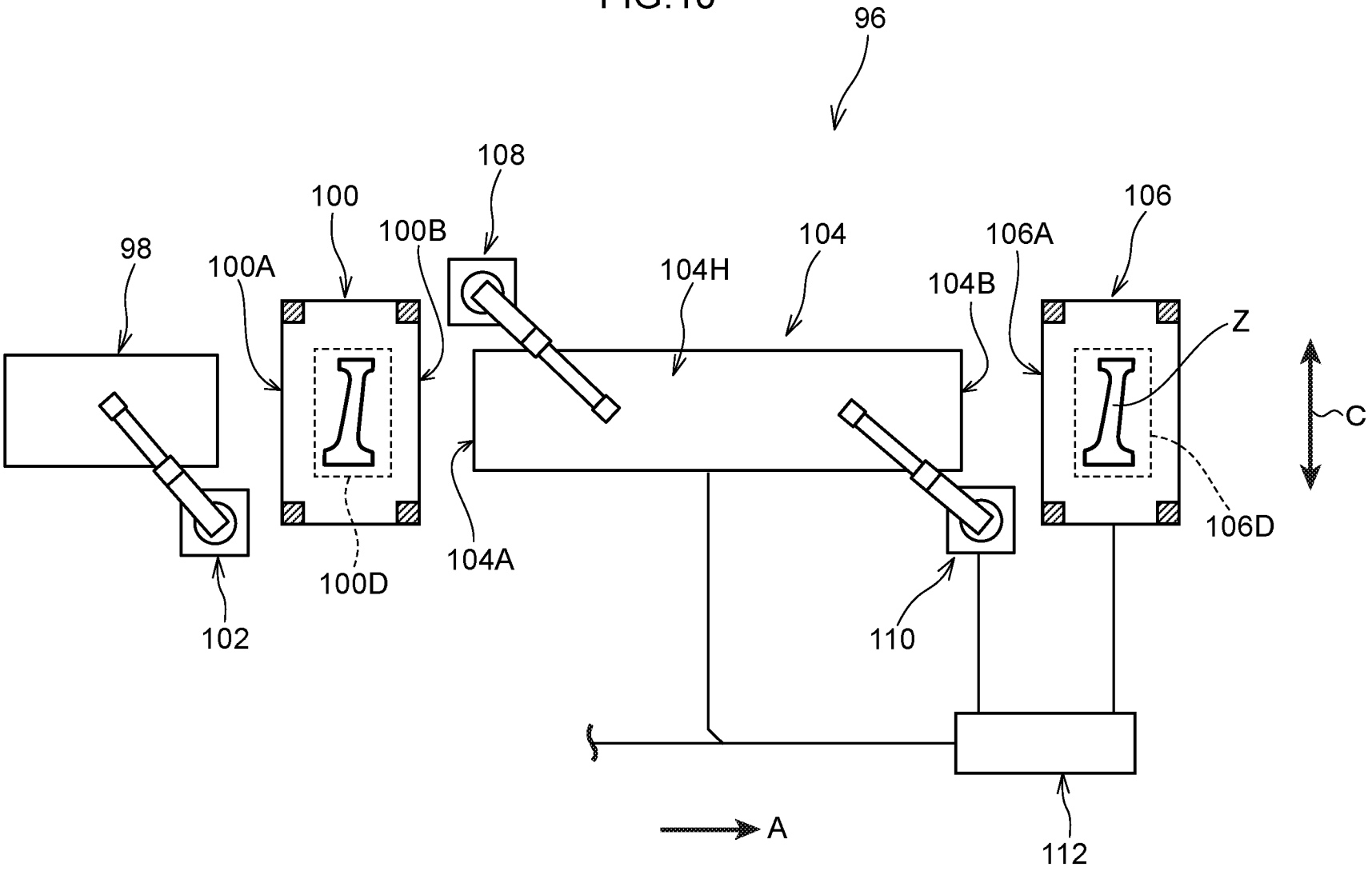
FIG. 10 is a schematic plan view illustrating a hot press device according to a sixth exemplary embodiment.

FIG. 10 is a diagram illustrating a hot press device 96 according to the present exemplary embodiment. A heating furnace 98 is provided on a conveyance direction upstream side of the material Z being processed and a press 100 is provided on a downstream side of the heating furnace 98. A first manipulator 102, serving as an example of a conveyance device linking the heating furnace 98 and the press 100 together, is provided alongside the heating furnace 98. The heating furnace 98 and the press 100 are disposed within a conveyance range of the material Z by the first manipulator 102.

A roller hearth heating furnace 104, serving as an example of a heating furnace, is provided on a downstream side of the press 100, and a press 106 is provided on a downstream side of the roller hearth heating furnace 104. A removal port 100B of the press 100 opposes an insertion port 104A of the roller hearth heating furnace 104, and a discharge port 104B of the roller hearth heating furnace 104 opposes an insertion port 106A of the press 106.

The roller hearth heating furnace 104 is configured similarly to its equivalent in the fourth exemplary embodiment. The material Z that has been inserted through the insertion port 104A is conveyed to the discharge port 104B while being heated. An in-furnace conveyance section 104H of the roller hearth heating furnace 104 that conveys the material Z from the insertion port 104A to the discharge port 104B is configured by a roller mechanism, and configures part of a conveyance path.

A second manipulator 108, serving as an example of a conveyance device linking the press 100 and the roller hearth heating furnace 104 together, is provided alongside the press 100, between the press 100 and the roller hearth heating furnace 104. The removal port 100B of the press 100 and the insertion port 104A of the roller hearth heating furnace 104 are provided within a conveyance range of the material Z by the second manipulator 108.

A third manipulator 110, serving as an example of a conveyance device linking the roller hearth heating furnace 104 and the press 106 together, is provided between the roller hearth heating furnace 104 and the press 106 alongside the roller hearth heating furnace 104. The discharge port 104B of the roller hearth heating furnace 104 and the insertion port 106A of the press 106 are provided within a conveyance range of the material Z by the third manipulator 110.

The presses 100, 106 and the manipulators 102, 108, 110 are similar in structure to their equivalents in the first exemplary embodiment.

Explanation follows regarding operation of the present exemplary embodiment configured as described above. The manipulators 102, 108, 110, the presses 100, 106, the heating furnaces 98, 104, and the like are operated according to commands from a controller 112, similarly to in the first exemplary embodiment. Explanation regarding the commands from the controller 112 will be omitted.

The material Z (heated blank) is heated by the heating furnace 98 for a predetermined duration (for example 4 minutes) after reaching a predetermined temperature (for example 1000° C.), and is then removed and set on a lower die 100D of the press 100 by the first manipulator 102.

The press 100 lowers its upper die to press form the material Z (heated blank) clamped between the upper die and the lower die 100D. When this is performed, the heat of the material Z (heated blank) is rapidly removed by the upper die and the lower die 100D. The heat removal amount is particularly large when the dies reach bottom dead center and the material Z is held clamped between the upper die and the lower die 100D. This corresponds to a first hot pressing.

The time taken from discharging the material Z (heated blank) from the heating furnace 98 to holding the material Z (heated blank) clamped between the upper die and the lower die 100D is managed. The time is, for example, approximately 8 seconds.

The material Z (heated blank) is pressed so as to be held and cooled continuously for a predetermined pressing duration (for example 10 seconds) by the press 100, after which the upper die is raised.

The second manipulator 108 lifts up and conveys the pressed material Z (intermediate product) from the lower die 100D to the insertion port 104A of the roller hearth heating furnace 104 using the hooking holding mechanism.

The material Z (intermediate product) is heated while being moved through the inside of the roller hearth heating furnace 104 for 2 minutes by driving the rollers, and is discharged through the discharge port 104B after reaching a predetermined temperature (for example 900° C.).

The third manipulator 110 uses the hooking holding mechanism to hold and lift up the material Z (heated intermediate product) discharged through the discharge port 104B of the roller hearth heating furnace 104, and set the material Z (heated intermediate product) on a lower die 106D of the press 106 through the insertion port 106A.

The press 106 lowers its upper die to press form the material Z (heated intermediate product) clamped between the upper die and the lower die 106D. When this is performed, the heat of the material Z (heated intermediate product) is rapidly removed by the upper die and the lower die 106D. The heat removal amount is particularly large when the dies reach bottom dead center and the material Z is held clamped between the upper die and the lower die 106D. This corresponds to a second hot pressing.

The time taken from discharging the material Z (heated intermediate product) from the roller hearth heating furnace 104 to holding the material Z (heated intermediate product) clamped between the upper die and the lower die 106D is managed. The time is, for example, approximately 8 seconds.

The material Z (heated intermediate product) is pressed so as to be held and cooled continuously for a predetermined pressing duration (for example 15 seconds) by the press 106, after which the upper die is raised and the press 106 is opened. A lifting mechanism (not illustrated in the drawings) of the press 106 lifts up and releases the pressed material Z (formed product) from the lower die 106D. The third manipulator 110 then lifts up and conveys the material Z (formed product) from the lower die 106D to be passed to a subsequent process.

In this manner, the hot press device 96 of the present exemplary embodiment is capable of exhibiting similar operation and advantageous effects to those of the exemplary embodiments described above.

Moreover, in the present exemplary embodiment, employing the roller hearth heating furnace 104 as a heating furnace enables part of the conveyance device to be configured by the roller hearth heating furnace 104.

The removal port 100B of the press 100 and the insertion port 104A of the roller hearth heating furnace 104 are disposed so as to oppose each other, and the discharge port 104B of the roller hearth heating furnace 104 and the insertion port 106A of the press 106 are disposed so as to oppose each other. This enables a drop in the temperature of the material Z during conveyance to be suppressed.

THE REFERENCE NUMERALS ARE EXPLAINED BELOW

10 hot press device
12 press
14 press
16 first manipulator
18 heating furnace
18B discharged state
18C stored state
20 conveyance table
24 controller
30 hot press device
32 conveyance mechanism
36 hot press device
38 second heating furnace
40 hot press device
44 continuous roller hearth heating furnace
46 first manipulator
50 multi-tiered heating furnace
52 press
54 press
56 second manipulator
60 controller
64 hot press device
68 continuous roller hearth heating furnace
70 press
72 second manipulator
74 roller hearth heating furnace
76 third manipulator
78 conveyance table
82 multi-tiered heating furnace
84 press
86 press
88 fourth manipulator
92 controller
96 hot press device
98 heating furnace
100 press
100B removal port
102 first manipulator
104 roller hearth heating furnace
104A insertion port
104B discharge port
106 press
106A insertion port
108 second manipulator
110 third manipulator
112 controller Supplement The following aspects may be generalized from the present specification.

Namely, a hot press device of a first aspect, comprising:
a first press;
a second press;
a conveyance device linking the first press and the second press together; and
a heating furnace provided within a conveyance range of the conveyance device.

A hot press device according to a second aspect is the first aspect, wherein the conveyance device has a function of conveyance to the heating furnace from the first press or from the second press.

A hot press device according to a third aspect is the first aspect or the second aspect, further including a conveyance mechanism configured to move a material between a first placement position within the heating furnace and a second placement position within the conveyance range.

A hot press device according to a fourth aspect is the third aspect, wherein the conveyance mechanism is configured to convey back and forth between the first placement position and the second placement position.

A hot press device according to a fifth aspect is the third aspect or the fourth aspect, wherein the second placement position faces at least one of an insertion port of the first press or an insertion port of the second press.

A hot press device according to a sixth aspect is any one of the third aspect to the fifth aspect, further comprising a controller that controls the conveyance device such that pressed material is removed from the first press and the pressed material is conveyed to the second placement position.

A hot press device according to a seventh aspect is any one of the first aspect to the sixth aspect, wherein the conveyance device includes an in-furnace conveyance section configured to convey material from an insertion port of the heating furnace to a discharge port of the heating furnace.

A hot press device according to an eighth aspect is the seventh aspect, wherein a removal port of the first press opposes the insertion port of the heating furnace, and the discharge port of the heating furnace opposes an insertion port of the second press.

A hot press device according to a ninth aspect is any one of the first aspect to the seventh aspect, further including another heating furnace provided within the conveyance range of the conveyance device.

The disclosure of Japanese Patent Application No. 2016-173990, filed on Sep. 6, 2016, is incorporated in its entirety by reference herein.

All cited documents, patent applications, and technical standards mentioned in the present specification are incorporated by reference in the present specification to the same extent as if each individual cited document, patent application, or technical standard was specifically and individually indicated to be incorporated by reference.

The invention claimed is:

1. A hot press device, comprising:
a heating furnace;
a first press provided with a die including a coolant flow path;
a second press provided with another die including a coolant flow path;
a conveyance device linking the first press and the second press together, the conveyance device including a manipulator; and a controller configured to control the manipulator to convey to the heating furnace from the first press, and further configured to convey to the first press and second press from the heating furnace.

2. The hot press device of claim 1, further comprising a conveyance mechanism including a plurality of rollers configured to move a material between a first placement position within the heating furnace and a second placement position within a conveyance range.

3. The hot press device of claim 2, wherein the conveyance mechanism is configured to convey the material back and forth between the first placement position and the second placement position.

4. The hot press device of claim 2, wherein the second placement position faces at least one of an insertion port of the first press or an insertion port of the second press.

5. The hot press device of claim 2, wherein the controller is further configured to control the conveyance device to remove pressed material from the first press and the pressed material is conveyed to the second placement position.

6. The hot press device of claim 1, wherein the conveyance device includes an in-furnace conveyance section including a roller configured to convey material from an insertion port of the heating furnace to a discharge port of the heating furnace.

7. The hot press device of claim 6, wherein a removal port of the first press opposes the insertion port of the heating furnace, and the discharge port of the heating furnace opposes an insertion port of the second press.

8. The hot press device of claim 1, further comprising another heating furnace provided within a conveyance range of the conveyance device.

9. The hot press device of claim 1, wherein the manipulator includes a single articulated arm.

* * * * *